US011766069B2

(12) United States Patent
Hauth et al.

(10) Patent No.: US 11,766,069 B2
(45) Date of Patent: Sep. 26, 2023

(54) PRE-ROLL CONE FOLDING SYSTEM AND METHOD OF USING

(71) Applicant: FOLD N GO LLC, Terrebonne, OR (US)

(72) Inventors: Tyler D. Hauth, Terrebonne, OR (US); Samual C. Walker, Terrebonne, OR (US)

(73) Assignee: FOLD N GO LLC, Terrebonne, OR (US)

( * ) Notice: Subject to any disclaimer, the term of this patent is extended or adjusted under 35 U.S.C. 154(b) by 265 days.

(21) Appl. No.: 17/372,219

(22) Filed: Jul. 9, 2021

(65) Prior Publication Data

US 2022/0104535 A1 Apr. 7, 2022

Related U.S. Application Data

(60) Provisional application No. 63/087,818, filed on Oct. 5, 2020.

(51) Int. Cl.

| | |
|---|---|
| ***A24C 5/54*** | (2006.01) |
| ***A24C 5/42*** | (2006.01) |
| ***A24C 5/40*** | (2006.01) |

(52) U.S. Cl.

CPC ..... *A24C 5/54* (2013.01); *A24C 5/40* (2013.01); *A24C 5/42* (2013.01)

(58) Field of Classification Search

CPC ..... A24C 5/40; A24C 5/42; A24C 5/54

See application file for complete search history.

(56) References Cited

U.S. PATENT DOCUMENTS

| | | | | |
|---|---|---|---|---|
| 1,186,089 | A * | 6/1916 | Fox | A24C 5/42 131/75 |
| 10,154,686 | B2 | 12/2018 | Heidtmann | |
| 2019/0320710 | A1* | 10/2019 | Sirois | A24C 5/54 |
| 2021/0015145 | A1* | 1/2021 | Bryant | A24C 5/54 |
| 2021/0022389 | A1* | 1/2021 | Giddings | B65B 49/08 |
| 2021/0392944 | A1* | 12/2021 | Kustal | A24C 5/02 |

FOREIGN PATENT DOCUMENTS

WO WO 02/056714 A1 7/2002

OTHER PUBLICATIONS

"Atomic Closer Automated Pre-Roll Machine—STM CANNA", STM CANNA, two links: 1) https://stmcanna.com/atomic-closer-automated-pre-roll-machine/ Accessed Oct. 10, 2022 2) https://www.youtube.com/watch?v=nrvphEYjDJA Accessed Dec. 12, 2022.

* cited by examiner

*Primary Examiner* — Eric Yaary
(74) *Attorney, Agent, or Firm* — Jose R Mata

(57) ABSTRACT

A pre-roll cone folding system for use in folding top portions of pre-roll cones, including at least (A) one or more pre-roll cone holders, a given one of the one or more pre-roll cone holders including at least a sloped cavity for supporting a pre-roll cone with a top portion of the pre-roll cone protruding from the sloped cavity; (B) one or more pre-roll cone folders for engaging the one or more pre-roll cone holders, a given pre-roll cone folder of the one or more pre-roll cone folders including at least (1) a receptacle to receive at least a portion of the protruding top portion of the pre-roll cone, and (2) a slot; and (C) a pre-roll cone plunger with a shaft for insertion through the slot of the given pre-roll cone folder and with a shaper for shaping at least the top portion of the pre-roll cone.

20 Claims, 25 Drawing Sheets

PRE-ROLL CONE FOLDING SYSTEM AND METHOD OF USING

PRIORITY APPLICATION

The present application claims priority to U.S. Provisional Patent Application Ser. No. 63/087,818 entitled "PRE-ROLL CONE FOLDING SYSTEM AND METHOD OF USING" and filed on Oct. 5, 2020, which is hereby fully incorporated by reference herein in its entirety.

TECHNICAL FIELD

Embodiments of this application relate to systems for folding pre-roll cones. In particular, some embodiments relate to systems that include at least a holder, a folder, and a plunger.

BACKGROUND

A pre-roll cone is a cigarette-type product that has not yet been folded, but which has been formed into a roll. A pre-roll cone may or may not be filled with filler product (e.g. tobacco, herbs, etc.). A pre-roll cone must be folded to form a finished product.

SUMMARY

The following summary introduces at a high level a limited number of topics described in the Detailed Description. This summary is not intended to identify key or essential features and should not be used for that purpose. In addition, this summary is not intended to be used as a guide to the scope of the claims. Instead, this Summary is provided as an introduction for the reader.

Some embodiments provide at least a pre-roll cone folding system configured for use in folding one or more top portions of one or more pre-roll cones, the system including at least one or more pre-roll cone holders, a given pre-roll cone holder of the one or more pre-roll cone holders including at least one or more supporting walls defining a sloped cavity configured for supporting a pre-roll cone with a top portion of the pre-roll cone protruding from the sloped cavity; one or more pre-roll cone folders configured for engaging the one or more pre-roll cone holders, a given pre-roll cone folder of the one or more pre-roll cone folders including at least (1) a receptacle that is configured to receive at least a portion of the protruding top portion of the pre-roll cone and (2) a slot; and a pre-roll cone plunger configured with a shaft for insertion through the slot of the given pre-roll cone folder and with a shaper configured for shaping at least the top portion of the pre-roll cone while it is disposed within the receptacle of the given pre-roll cone folder.

Some embodiments also include one or more methods of using a pre-roll cone folding system.

BRIEF DESCRIPTION OF THE FIGURES

Various embodiments are described below with reference to drawings which are now summarized. It should be noted that drawings are not necessarily to scale. In addition, the drawings are simplified to avoid obscuring important principles with unnecessary details.

DETAILED DESCRIPTION

Figure 1:
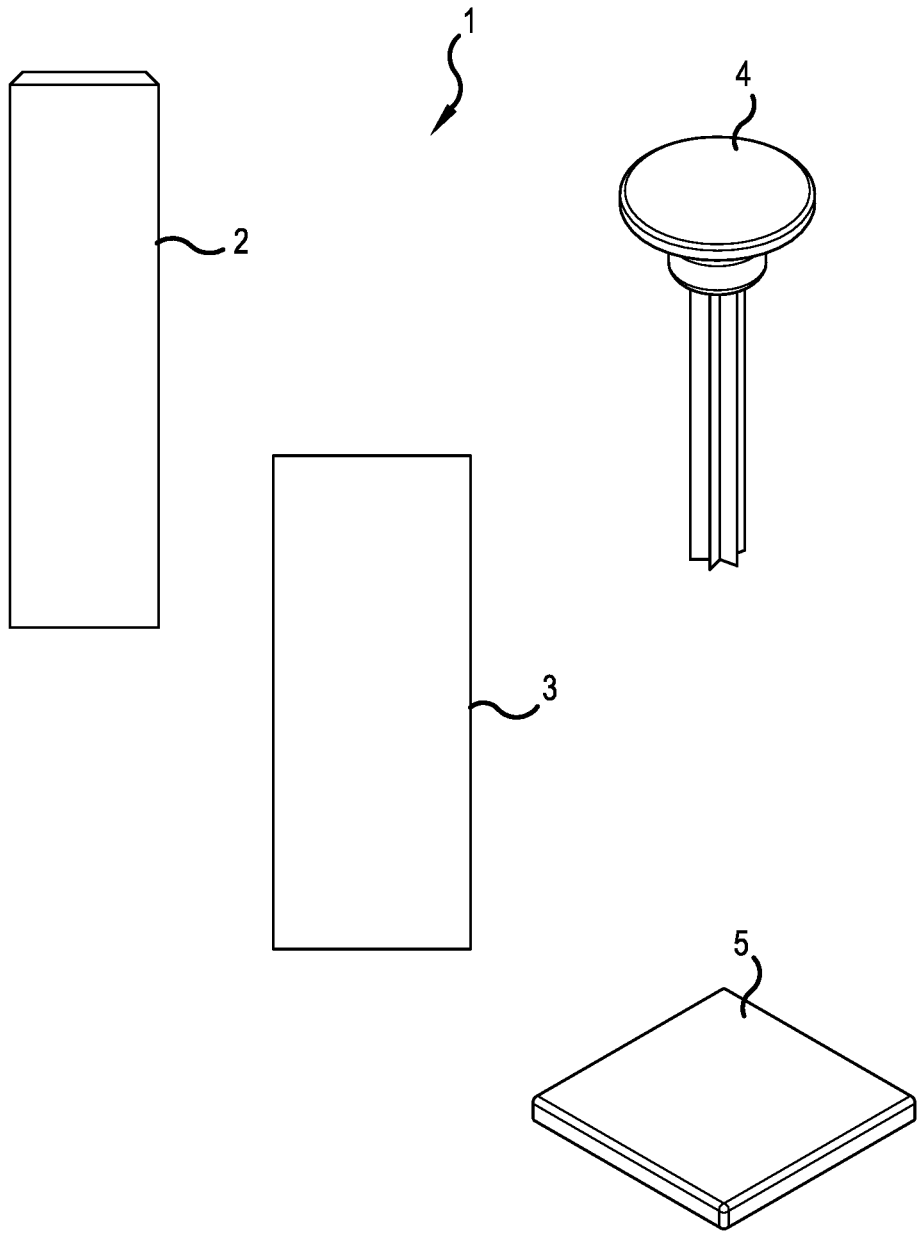
FIG. 1 is a drawing of an example pre-roll cone folding system consistent with some embodiments. A mix of two-dimensional and perspective views are utilized.

Some embodiments are now described with reference to the above-described figures. In the following description, multiple references are often made to "some embodiments." These references to "some embodiments" are not necessarily referring to the same embodiments, as numerous and varied embodiments are possible. No effort is made to describe all possible embodiments. Sufficient embodiments are described so that those skilled in the art will become appraised of the relevant principles. In addition, disclosed embodiments are not necessarily preferred or advantageous over other embodiments. Further all drawings illustrate merely example embodiments. Specific details in the drawings should not be used to limit the claims.

In some embodiments a pre-roll cone folding system is configured for use in folding one or more top portions of one or more pre-roll cones. The system including at least one or more pre-roll cone holders, a given pre-roll cone holder of the one or more pre-roll cone holders including at least one or more supporting walls defining a sloped cavity configured for supporting a pre-roll cone with a top portion of the pre-roll cone protruding from the sloped cavity; one or more pre-roll cone folders configured for engaging the one or more pre-roll cone holders, a given pre-roll cone folder of the one or more pre-roll cone folders including at least (1) a receptacle that is configured to receive at least a portion of the protruding top portion of the pre-roll cone and (2) a slot; and a pre-roll cone plunger configured with a shaft for insertion through the slot of the given pre-roll cone folder and with a shaper configured for shaping at least the top portion of the pre-roll cone while it is disposed within the receptacle of the given pre-roll cone folder.

In some further embodiments the system further incudes at least a pre-roll cone ejector configured for use in ejecting at least one pre-roll cone from the one or more pre-roll cone folders.

In some particular embodiments the given pre-roll cone folder further includes at least a crimping segment that is at least one of coupled with or integral with the receptacle that is shaped to pre-fold the pre-roll cone.

In some particular embodiments the one or more pre-roll cone holders includes at least a plurality of pre-roll cone holders and the one or more pre-roll cone folders includes at least a plurality of pre-roll cone folders. In some further particular embodiments the system further includes at least one pre-roll cone holder assembly that includes at least some of the plurality or pre-roll cone holders and at least one pre-roll cone folder assembly that includes at least some of the plurality of pre-roll cone folders.

Various embodiments are now described with reference to the figures. Referencing FIG. 1, pre-roll cone folding system 1 includes a pre-roll cone holder 2, a pre-roll cone folder 3, a plunger 4, and optionally an ejector 5. Each of these are discussed further below.

Figure 2:
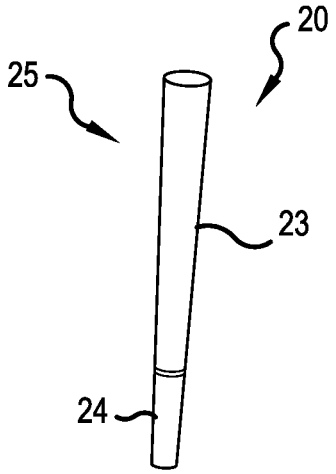
FIG. 2 is a perspective drawing of a pre-roll cone consistent with some embodiments.

Referencing FIG. 2 in some embodiments a pre-roll cone 20 includes a paper portion 23, a bottom portion 24 (e.g. a filter), and a top portion 25. As shown the pre-roll cone 20 is rolled but the top portion 25 is not yet folded. Although the pre-roll cone may or may not be filled with filler (e.g. tobacco, herbs, etc.) prior to folding. The filler if present is not shown in FIG. 2.

Figure 7A:
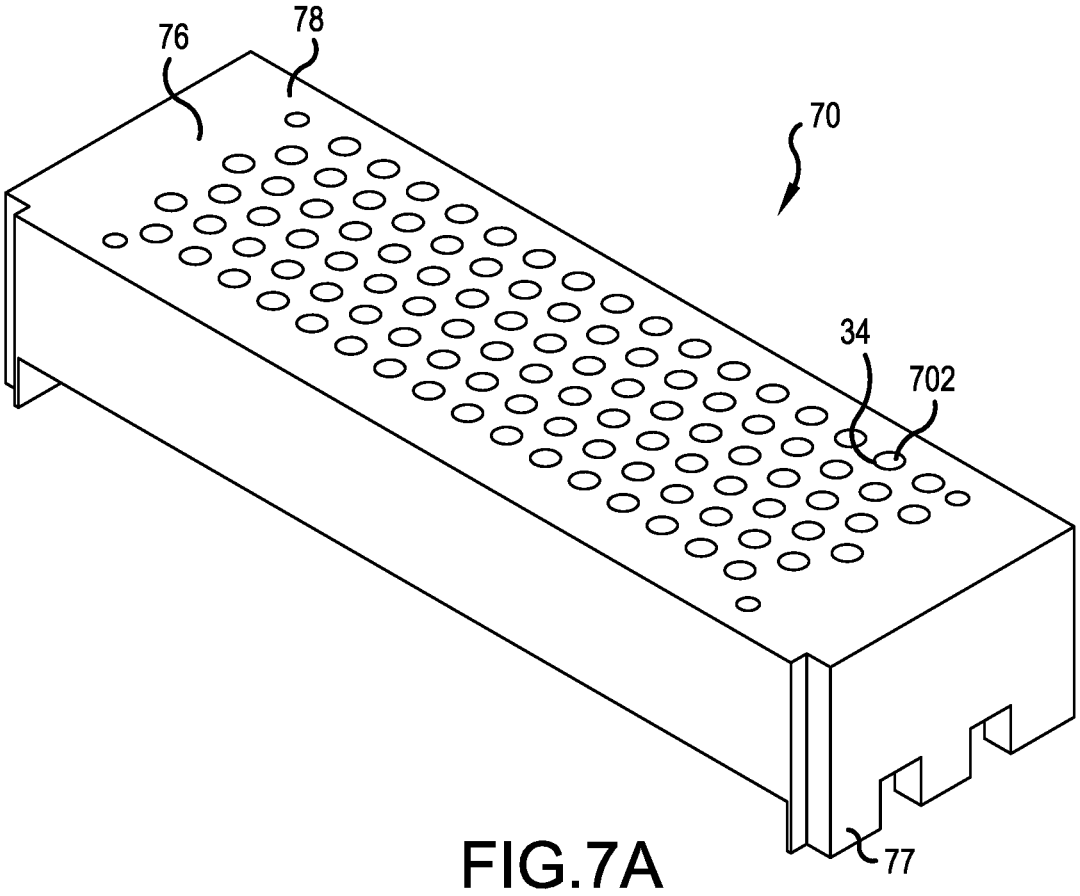
FIG. 7A is a perspective drawing of a pre-roll cone holder assembly consistent with some embodiments.
Figure 7B:
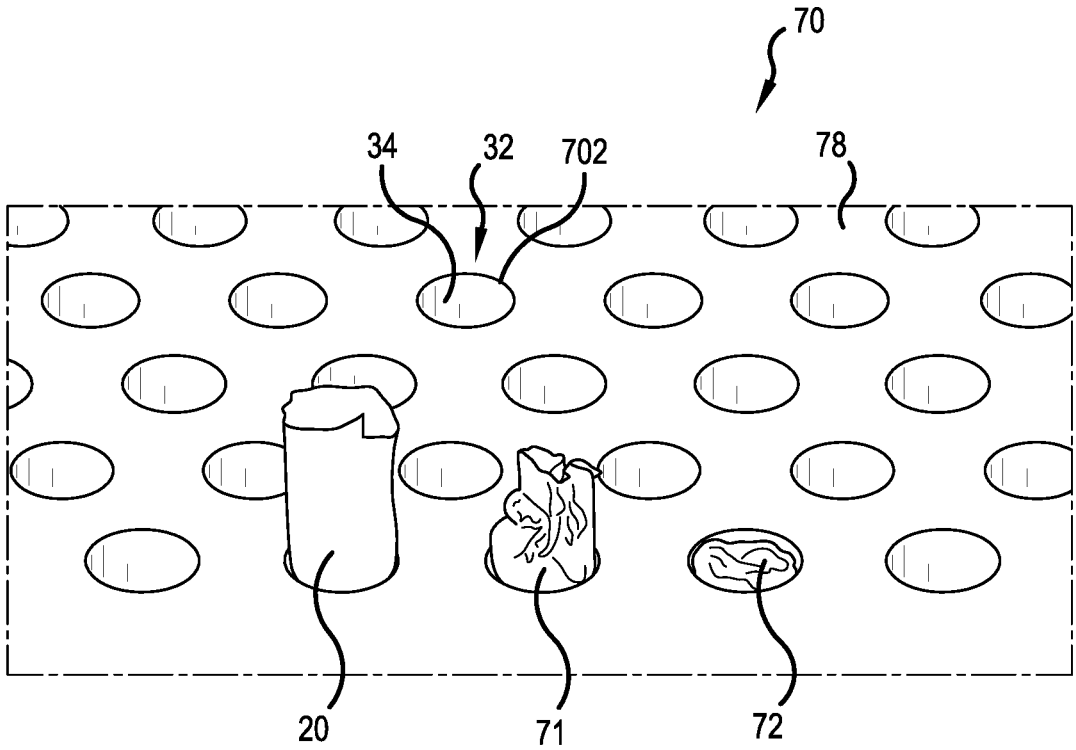
FIG. 7B is a close-up perspective drawing of a portion of an upper surface of a pre-roll cone holder assembly, showing a pre-roll cone, a pre-folded cone, and a folded cone resting on slanted cavities of the pre-roll cone holder assembly, consistent with some embodiments.
Figure 22:
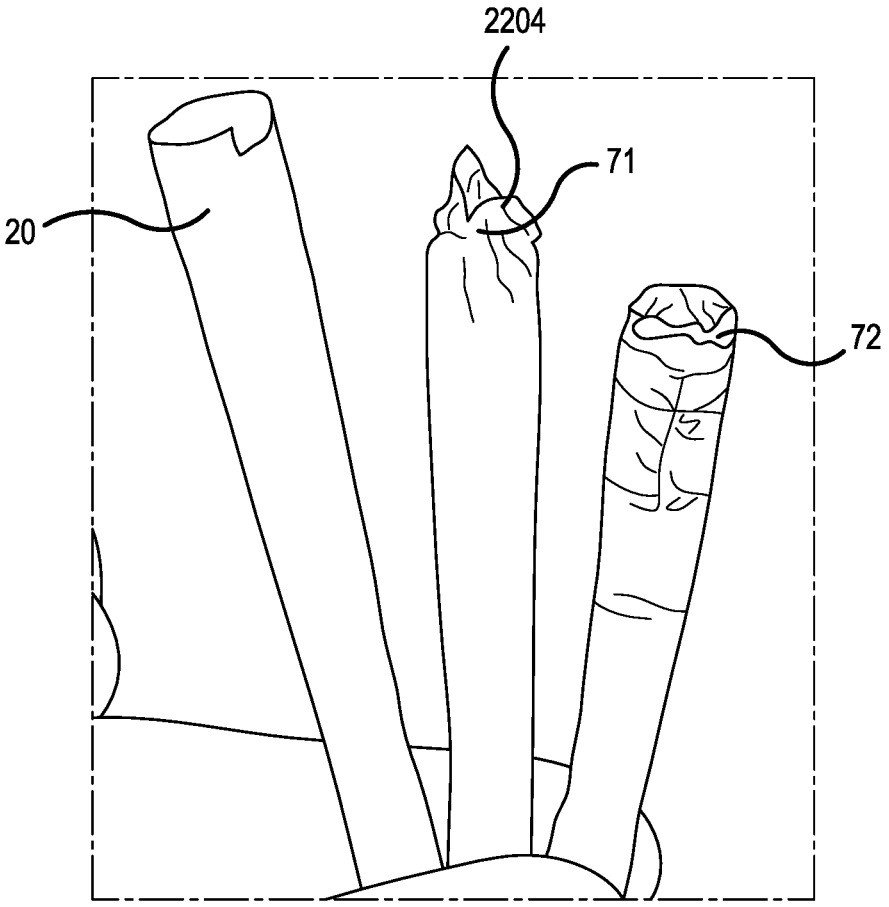
FIG. 22 is a perspective drawing of a pre-roll cone, a pre-folded cone, and a folded cone, consistent with some embodiments.

Moving forward to reference FIGS. 7B and 22, cones may be a pre-roll cone 20 before folding, a pre-folded cone 71 (e.g. crimped but not yet fully folded), and a folded cone 72.

Figure 3A:
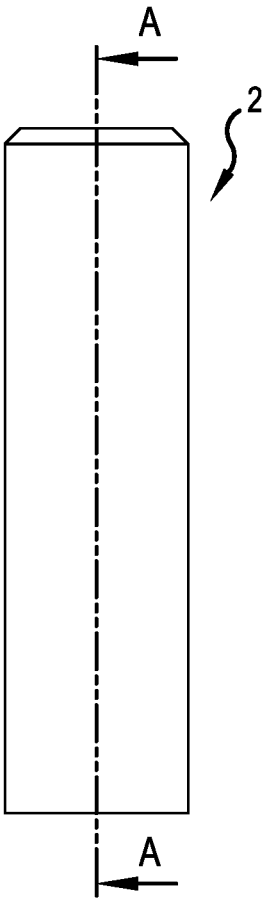
FIG. 3A is a two-dimensional view of a pre-roll cone holder consistent with some embodiments, showing via arrows A-A a direction of view for sectional drawing FIG. 3B.
Figure 3B:
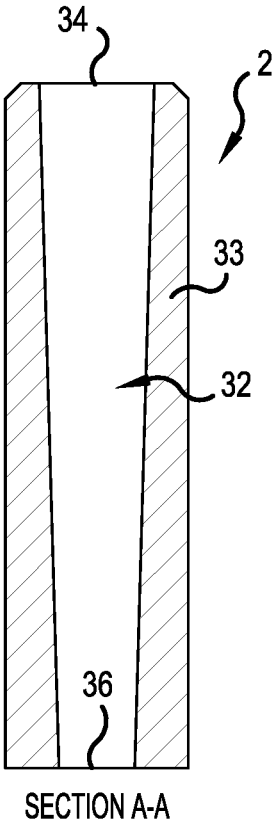
FIG. 3B is a two-dimensional sectional view of a pre-roll cone holder consistent with some embodiments, showing a sectional view consistent with the direction of arrows A-A of FIG. 3A.

Referencing FIGS. 3A and 3B, in some embodiments a pre-roll cone holder 2 includes at least one or more supporting walls 33 that define a sloped cavity 32 configured for receiving and supporting pre-roll cones 20 for folding. The sloped cavity 32 may include a top opening 34 for receiving the pre-roll cones 20 and a bottom opening 36. When pre-roll cones 20 are supported in the sloped cavity 32, top portions 25 of the pre-roll cones 20 may protrude from the top opening 34 and at least bottom portions 24 of the pre-roll cones 20 may protrude from the bottom opening 36.

Thus, as used herein, the term "cavity" refers to a enclosed area with either a top opening, a bottom opening, or both. In the case where cavity 32 has both a top and a bottom opening, it defines at least one of a tube (e.g. a tapered tube) or a channel (e.g. a tapered channel). Further, although in the above drawings the cavity has a circular top opening, this is not intended to be limiting. In different embodiments circular, square, pentagonal or other shapes are possible. All of the above uses of the term cavity are within the scope of this disclosure.

The one or more supporting walls 33 of a holder 2 define a slope or taper that is configured for holding a pre-roll 20 in a stable fixed position for pre-folding and folding without allowing a pre-roll cone 20 to fall out through a bottom opening 36, if there is one. The size of the cavity depends at least on the size of the pre-roll cones that are to be folded. Thus, where these is a bottom opening, the one or more supporting walls 33 define at least one of a tapered tube or a tapered channel that is sufficiently narrow and tapered to hold a pre-roll cone is a stable fixed position for folding, without allowing the pre-roll cone to fall out through the bottom opening 36.

Figure 4A:
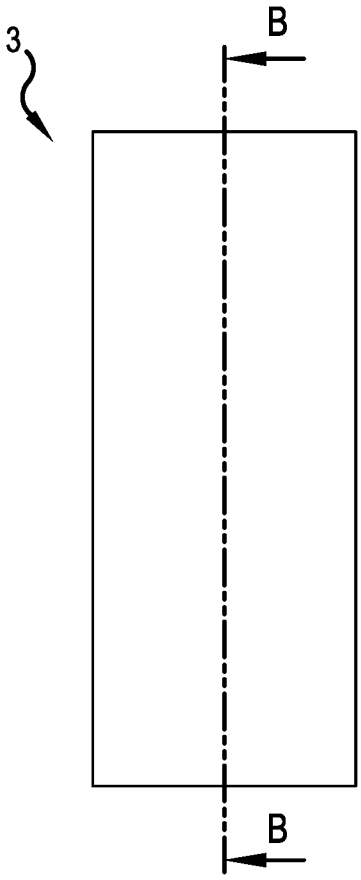
FIG. 4A is a two-dimensional view of a pre-roll cone folder consistent with some embodiments, showing via arrows B-B a direction of view for sectional drawing FIG. 4B.
Figure 4B:
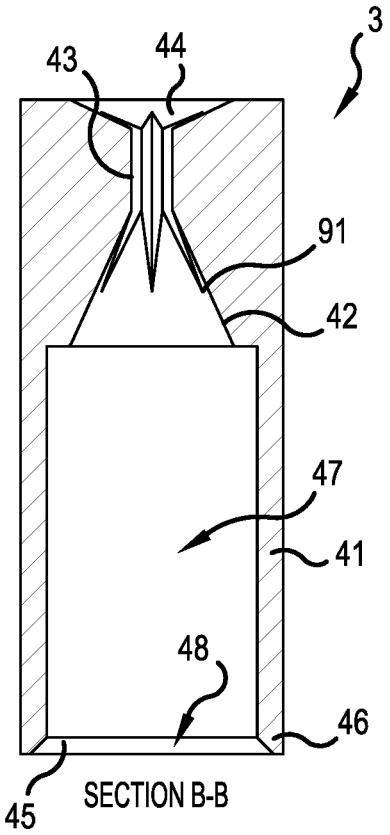
FIG. 4B is a two-dimensional cross-sectional view of a pre-roll cone holder consistent with some embodiments, showing a sectional view consistent with the direction of arrows B-B of FIG. 4A.

Referencing FIGS. 4A and 4B, in some embodiments a pre-roll cone folder 3 may include a receptacle 41 that defines a receiving cavity 47. The receptacle 41 including a rim 46 that defines a receiving opening 48. The rim 46 may further include a bottom recess 45 at the receiving opening 48. The receptacle 41 may be configured to engage the pre-roll cone holder 2 (e.g. with rim 46) and to accept within the receptacle 41 at least a top portion 25 of a pre-roll cone 20 supported in the sloped cavity 32 of the pre-roll cone holder 2. In some embodiments the receptacle 41 further defines or includes a crimping segment 42 opposite the rim 46. The crimping segment 42 defines a portion of the receiving cavity 47. The crimping segment 42 defines an at least partially narrowed portion of receiving opening 48 and/or receptacle 41 for partially compressing (e.g. into at least one of a crimped, tapered, cone shape, tent-like shape, dome shape, or other partially compressed shape) a top portion 25 of a pre-roll cone 20 lodged in receptacle 41 into a pre-folded state. The crimping segment 42 includes at least one of a cone shape, dome shape, or other compressive shape to engage a top portion 25 and partially compress it. A top portion 25 partially compressed by crimping segment 42 is said to be "pre-folded" because it renders the top portion 25 suitable for plunger 4. The crimping segment 42 is placed and configured to accept and partially compress a top portion 25 of a pre-roll cone 20 disposed within receiving cavity 47 to form pre-folded cone 71 with the top portion 25 of the pre-roll cone 25 in at least one of a crimped, tapered, cone shape, tent-like shape, dome shape, or other partially compressed shape. That is, when a top portion 25 of a pre-roll cone 20 is within the receptacle 41 (e.g. within receiving cavity 47) it will extend through receptacle 41 to reach crimping segment 42. The crimping segment 42 is configured to make contact with the top portion 25 and to partially compress it into a pre-folded configuration to form a pre-folded cone 71.

Further referencing FIGS. 4A and 4B, in some further embodiments a pre-roll cone folder 3 defines a slot 43, and a top recess 44. The slot 43 is located opposite the rim 46 and leads from outside the pre-roll cone folder 3 to inside the receiving cavity 47 (e.g. the at least partially narrowed portion of receiving cavity 47 defined by the crimping segment 42). The top recess 44 is optionally present to ease entry into the slot 43.

Figure 4C:
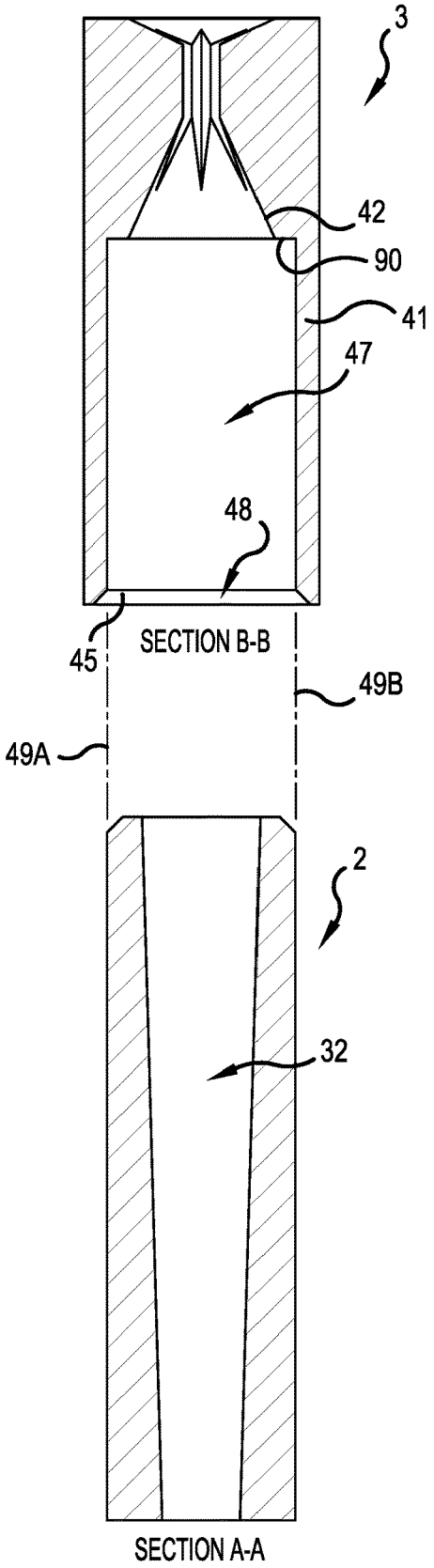
FIG. 4C is a two-dimensional cross-sectional drawing depicting a pre-roll cone folder and a pre-roll cone holder, consistent with some embodiments, showing a receiving cavity that is configured to receive at least a portion of the pre-roll cone holder.

Referencing FIG. 4C, a pre-roll cone folder 3 and a pre-roll cone holder 2 are shown in alignment via guide lines 49A, 49B for at least partial insertion of the pre-roll cone holder 2 into the receiving cavity 47. That is, the receiving cavity 47 of the pre-roll cone folder 4 is configured, including being sized, to receive at least a portion of the given pre-roll cone holder 2. In some embodiments pre-roll cone holder 2 is configured to be inserted (e.g. via receiving opening 48) until the pre-roll cone holder 2 makes contact with stop 90, a narrowing or other partial blockage of the receiving cavity 47 (for example, a step-like shape as shown in FIG. 4C) that stops further insertion of the pre-roll cone holder 2 into receiving cavity 47. The stop 90 is defined by receptacle 41, for example, at the beginning of a transition to crimping segment 42 (e.g. as shown). If a pre-roll cone (e.g. 20 of FIG. 2) is disposed within sloped cavity 32 with a top portion (e.g. 25 of FIG. 2) of a pre-roll cone protruding from the cavity 32, the said top portion (e.g. 25 of FIG. 2) may be positioned for crimping with the crimping segment 42.

Figure 5:
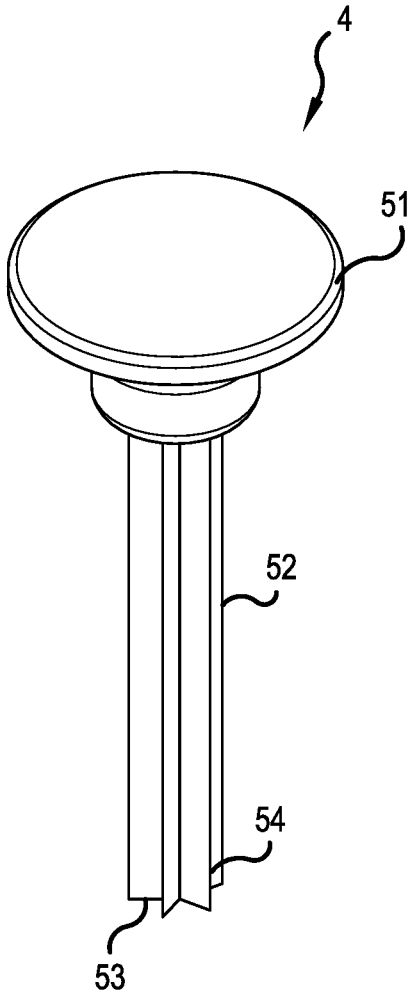
FIG. 5 is a perspective drawing of a plunger consistent with some embodiments.

Referencing FIG. 5, in some embodiments a plunger 4 includes a handle 51, a shaft 52, and a shaper 53. Shaper 53 may be defined by an end 54 of the shaft 52 opposite the handle 51. The shaper 53 and shaft 52 may be sized and shaped to fit through slot 43 of pre-roll cone folder 3 (e.g. perhaps guided by top recess 44) for engagement by shaper 53 with the top portion 25 of a pre-roll cone 20 disposed within receiving cavity 47 of pre-roll cone folder 3. The shaper 53 is a shape at the end 54 of shaft 52. In some embodiments, the shaper (see e.g. shaper 53, FIG. 8D) is shaped as at least one of a 6-pointed cross, a five-pointed cross, a square, a triangle, a circle, or other shape. When plunger 4 is inserted through slot 43 to contact top portion 25 of a pre-roll cone 20, it conveys a shape to top portion 25 that is dependent on the particular shape of shaper 53.

Figure 6:
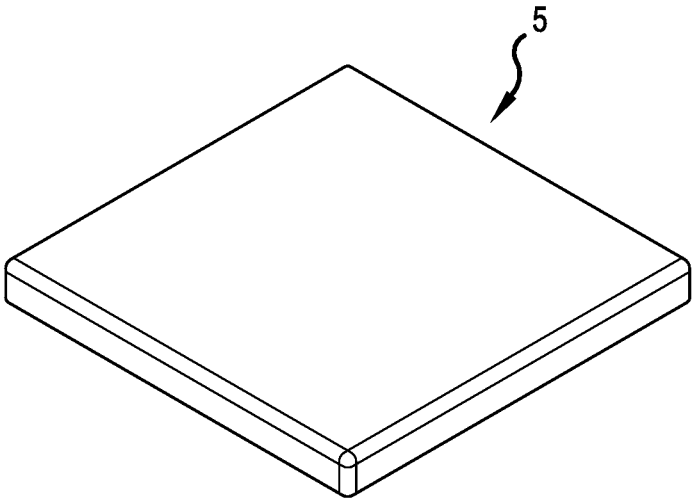
FIG. 6 is a perspective drawing of an optional ejector consistent with some embodiments.

Referencing FIG. 6, in some embodiments pre-roll cone folding system 1 includes an optional ejector 5 consistent with some embodiments. In some embodiments, as shown in FIG. 6, ejector 5 is a flat plate of a rigid material (e.g., plastic, wood, metal, etc.).

Discussion now turns to embodiments using a pre-roll cone holder assembly 70 that includes a plurality of pre-roll cone holders 702 (e.g. versions or embodiments of holders 3 with at least similar structures) and a pre-roll cone folder assembly 80 that includes a plurality of pre-roll cone folders 803. These are "assemblies" in the sense that they are structures that include a plurality of either pre-roll cone holders 702 or pre-roll cone folders 803.

Referencing FIG. 7A, in some embodiments a pre-roll cone folding system 1 may, instead of or in addition to a single pre-roll cone holder 2, provide a pre-roll cone holder assembly 70. As shown, in some embodiments pre-roll cone holder assembly 70 may include a plurality of pre-roll cone holders 702 configured for receiving and supporting a plurality of pre-roll cones 20. In some embodiments the pre-roll holder assembly 70 includes a body 76, one or more stands 77 for supporting the body 76, and an upper surface 78 of the body 76. The body 76 defining the plurality of pre-roll cone holders 702 and the upper surface 78 defining the top openings 34 of the pre-roll cone holders 702. Moving forward with reference to FIG. 17, body 76 further defines a bottom surface 79 which defines a plurality of bottom openings 36 of the plurality of pre-roll cone holders 702.

Referencing FIG. 7B, a close-up of an upper surface 78 of the pre-roll cone holder assembly 70 of FIG. 7A, shows a plurality of pre-roll cone holders 702 with their top openings 34 defined by the upper surface 78 and with their sloped cavities 32. Three cones are also shown in various states including a pre-roll cone 20 in an unfolded state, a pre-folded cone 71 in a pre-folded state (e.g. subjected to crimping segment 42 but not yet to plunger 4), and a folded cone 72.

Figure 8A:
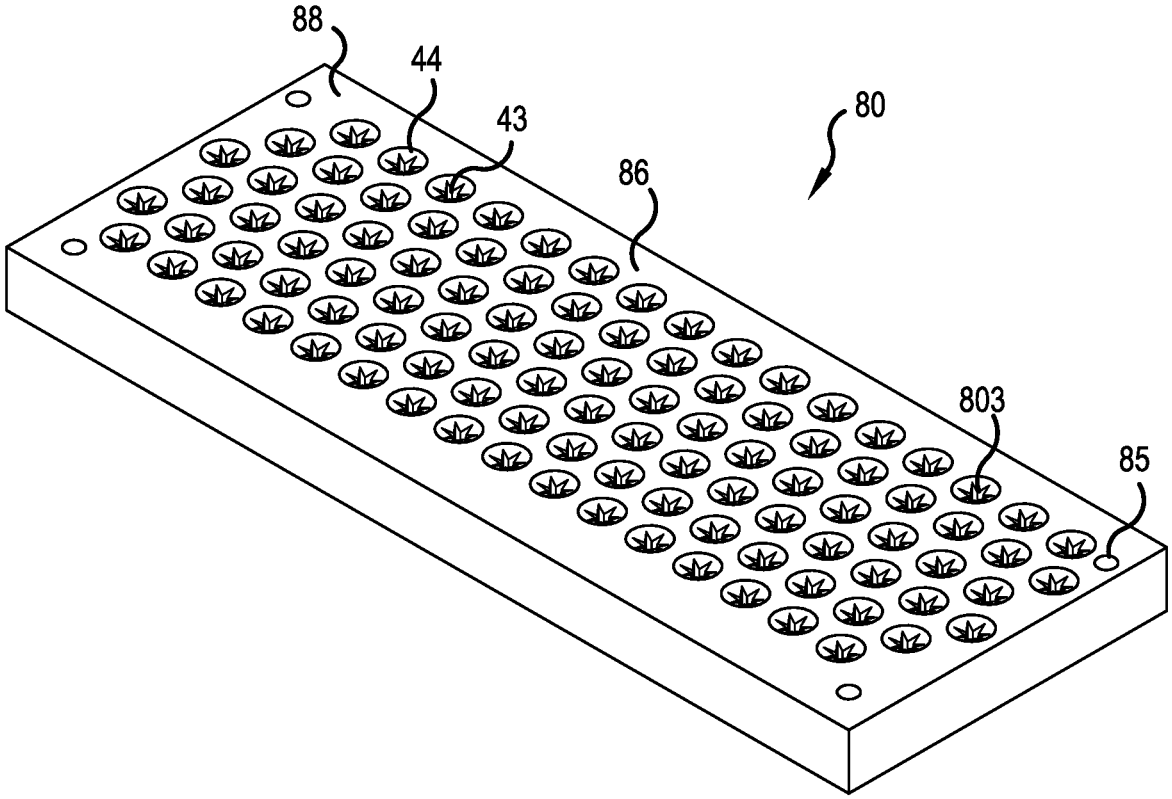
FIG. 8A is a perspective drawing of a pre-roll cone folder assembly consistent with some embodiments.

Referencing FIG. 8A, in some embodiments a pre-roll cone folding system 1 may, instead of or in addition to a single pre-roll cone folder 3, provide a pre-roll cone folder assembly 80. As shown, in some embodiments pre-roll cone folder assembly 80 may include a plurality of pre-roll cone folders 803 (e.g. a version or embodiment of folder 3 with at least similar structures). In some embodiments the pre-roll folder assembly 80 includes a body 86, an upper surface 88 of the body 86. The body 86 defining the plurality of pre-roll cone folders 803 with the upper surface 88 defining the top recesses 44 for accessing the slots 43 of the plurality of pre-roll cone folders 2.

Figure 8B:
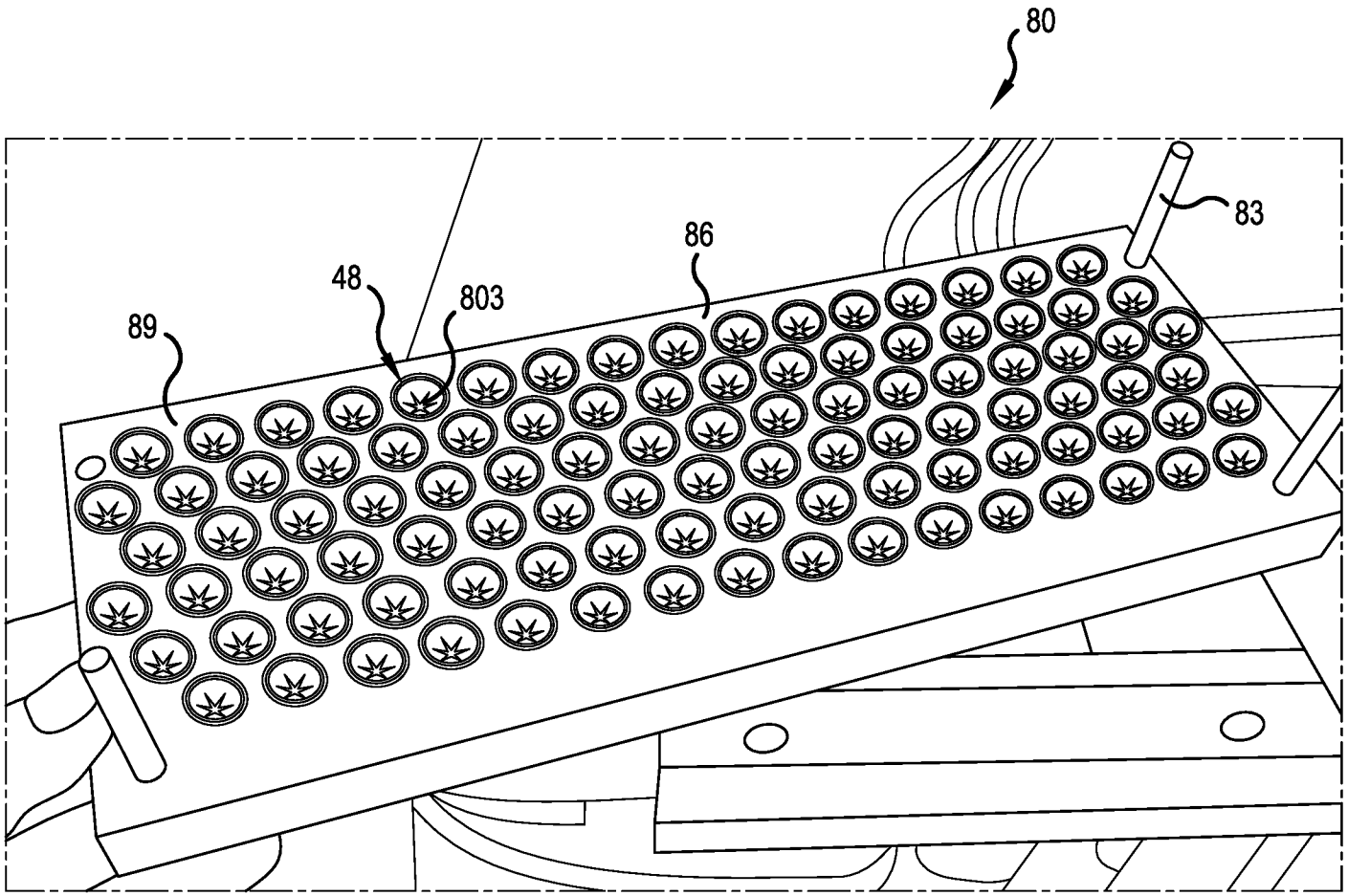
FIG. 8B is a perspective drawing of a lower surface of a pre-roll cone folder assembly consistent with some embodiments.
Figure 8C:
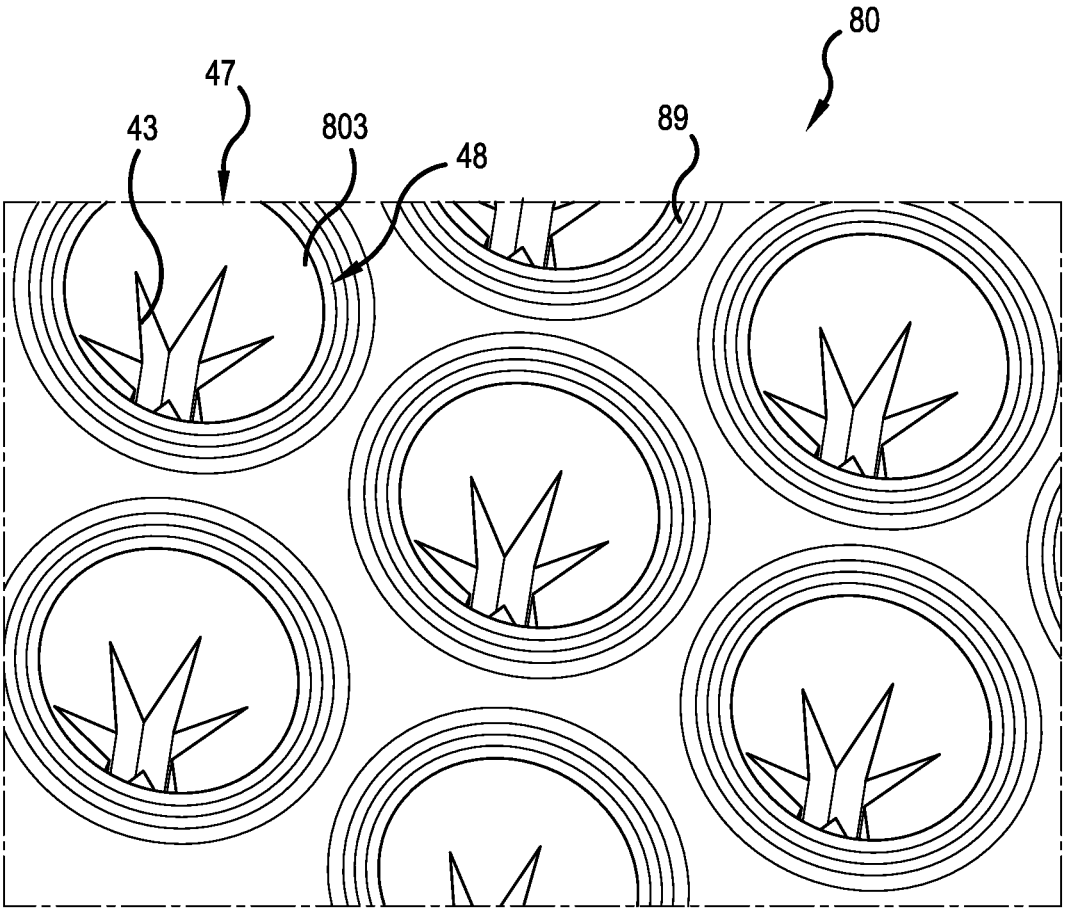
FIG. 8C is a close-up perspective drawing of a portion of the lower surface of FIG. 8B.

Referencing FIGS. 8B and 8C, body 86 further defines a bottom surface 89 opposite the upper surface 88 (e.g. of FIG. 8A) for engaging the upper surface 78 of the pre-roll cone holder assembly 70 and for providing access via receiving openings 48 to the receiving cavity 47 (shown in FIG. 8E) and/or receptacles 841 (shown in FIG. 8E) of the pre-roll cone folders 803. Some slots 43 in a six-point cross configuration are also shown via and from the perspective of receiving cavity 847. The six-point cross configuration of slot 43 is to match the six-point cross shape of shaper 53 of FIG. 8D, discussed below. Guide posts 83 (e.g. dowels) are inserted into holes (e.g. second holes 85 of FIG. 11) of pre-roll cone folder assembly 80 and are configured to mate with corresponding holes (e.g. first holes 75 of FIG. 11) in a pre-roll cone holder assembly 70 (e.g. of FIG. 7A).

Figure 13:
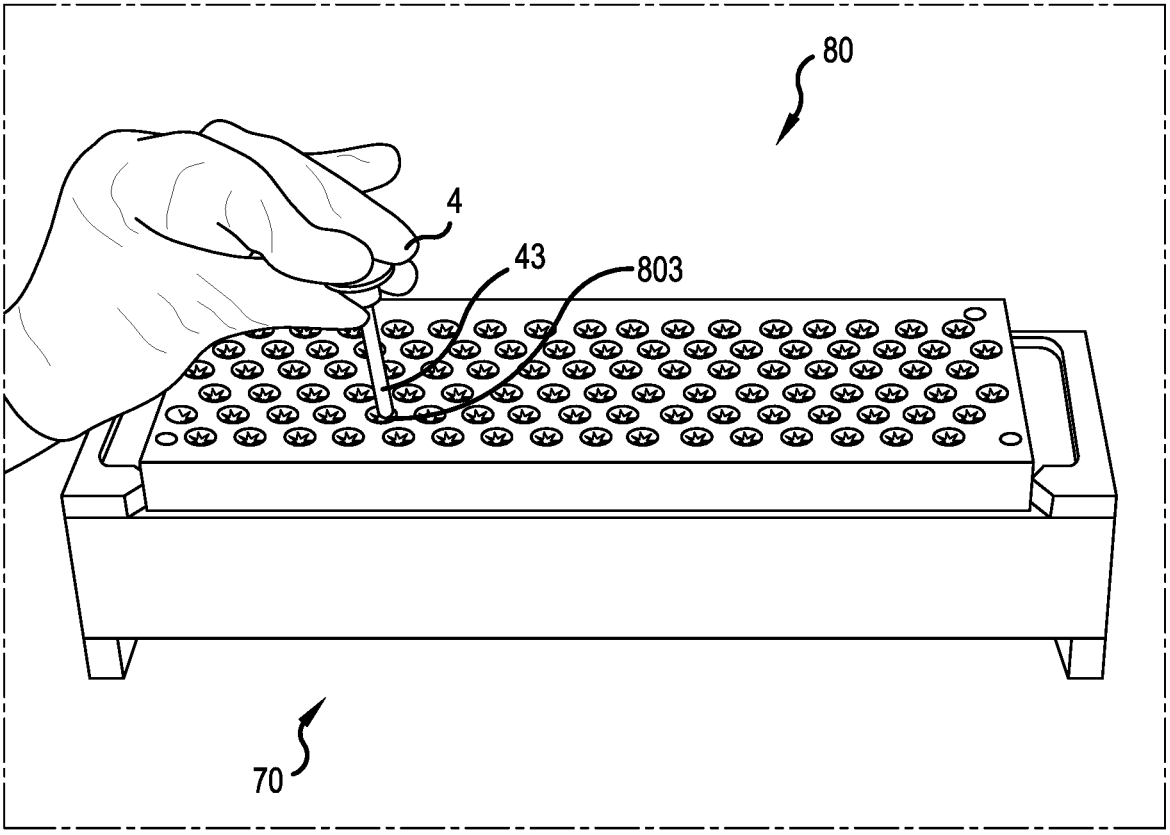
FIG. 13 is a perspective drawing of a plunger being inserted in a slot of the pre-roll cone folder assembly of FIGS. 11-12 after the pre-roll folder assembly is fully disposed on the plurality of pre-roll cones and on the pre-roll cone holder assembly of FIGS. 10-12 consistent with some embodiments.

In the embodiments discussed above relative to FIGS. 8B and 8C, a bottom surface 89 of a folder 803 engages a top surface 78 of a holder 702 (See, e.g. FIG. 13, infra.). The surface-to-surface contact is facilitated if both bottom surface 89 of folder 803 and top surface 78 of holder 702 are flat. However, in other possible embodiments a bottom surface 89 does not engage a top surface 78. For example, either the bottom surface 89 or the top surface 78 of holder 702 may not be flat. For example, the one or more supporting walls 33 of a holder 702 may protrude above top surface 78 to form annular protrusions, and it is these annual protrusions that may contact bottom surface 89 of folder 803. Similarly, a rim 46 of a receptacle 41 may protrude below bottom surface 89 of a folder 803, and it is this protruding rim that may make contact with top surface 78 of holder 702. There are also other possibilities. For example, either bottom surface 89 or top surface 78 may define either protrusions or recesses where protrusions on one surface may mate with recesses in the other surface. All of these variations are within the scope of this disclosure.

Figure 8D:
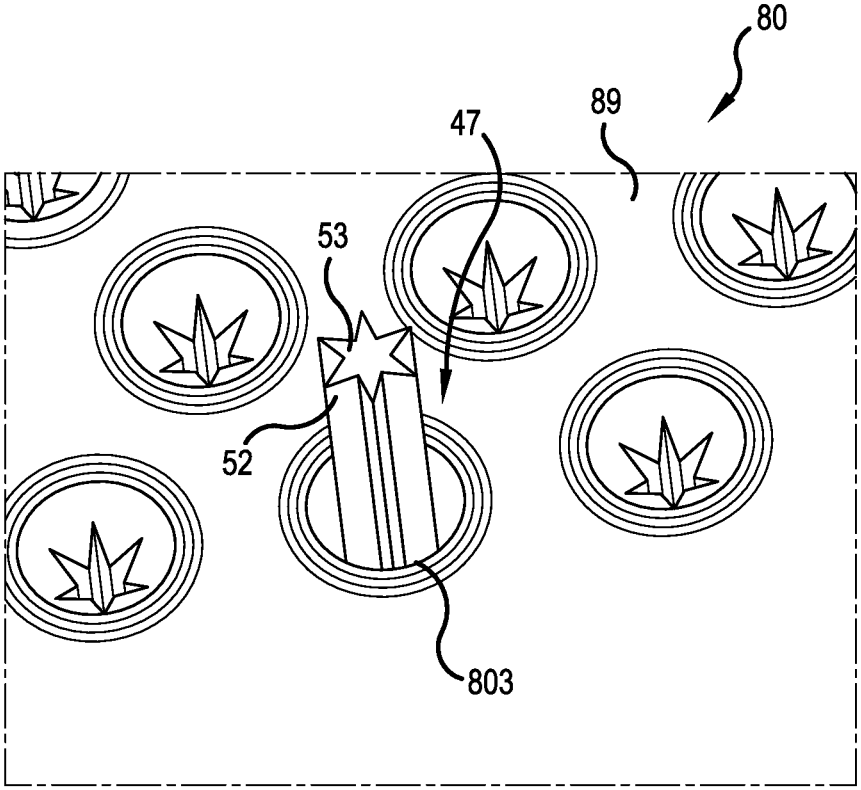
FIG. 8D is a close-up perspective drawing of a portion of the lower surface of FIG. 8B showing a plunger protruding through a slot.

Referencing FIG. 8D, a portion of a bottom surface 89 of the pre-roll cone folder assembly 80 is shown, including a plurality or pre-roll cone folders 803 with receiving cavities 847. For purposes of illustration, a shaft 52 of a plunger 4 is shown. The plunger 4 has been inserted to the reverse side (i.e. the upper surface 88 and its slots 43). A shaper 53 is also shown which in this embodiment has a six-point cross to match slot 43 of FIG. 8C which also has six-point cross configuration.

Figure 8E:
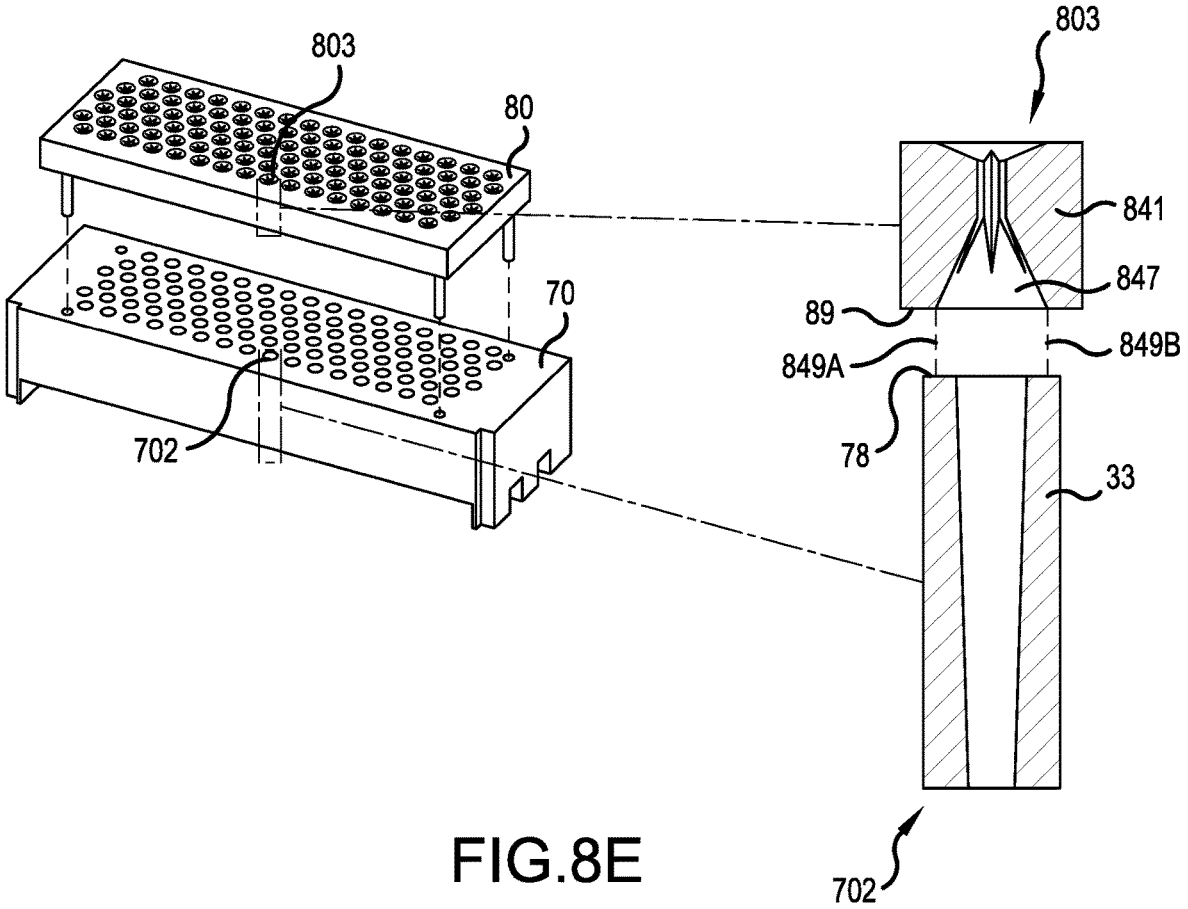
FIG. 8E is a two-dimensional cross-sectional drawing depicting, consistent with some embodiments, an alignment between a pre-roll cone folder of a pre-roll cone folder assembly and a pre-roll cone holder of a pre-roll cone holder assembly.

Referencing FIG. 8E, a pre-roll cone folder 803 and a pre-roll cone holder 702 are shown in alignment via guidelines 849A, 849B. Pre-roll cone folder 803 is, as is shown in the drawing, a part of pre-roll cone folder assembly 80 and pre-roll cone holder 702 is, as shown in the drawing, a part of pre-roll cone holder assembly 70. Shown is how the pre-roll cone folder 803 and the pre-roll cone holder 702 would align, consistent with some embodiments, to make contact via the bottom surface 89 of the pre-roll cone folder assembly 80 and top surface 78 of pre-roll cone holder assembly 70. In contrast to the discussion relative to FIG. 4C, pre-roll cone holder 702 does not insert within receiving cavity 847 defined by receptacle 841 of pre-roll cone folder 803. Instead, upper surface 78, which is defined partly by supporting walls 33 is configured to make contact with bottom surface 89. FIG. 8E is a simplified drawing intended to primarily illustrate the alignment discussed above.

Figure 21:
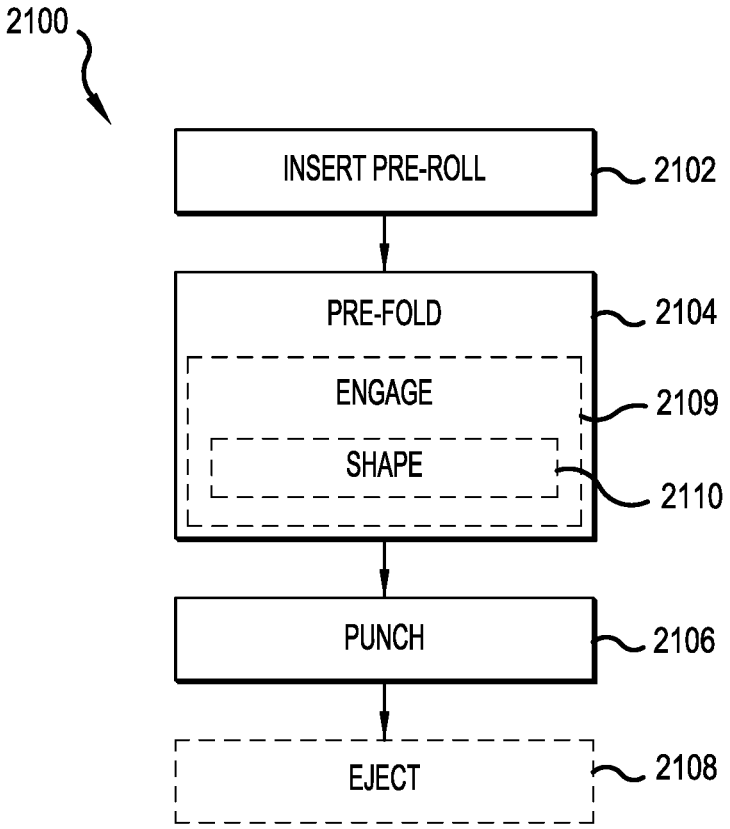
FIG. 21 is a flow chart illustrating an exemplary method of using a pre-roll cone folding system, consistent with some embodiments.

Moving forward with reference to FIG. 21, an exemplary method 2100 of using a pre-roll cone folding system 1 is provided. In some embodiments method 2100 includes an inserting a pre-roll cone operation (process block 2102). This includes inserting one or more pre-roll cones 20 into one or more sloped cavities 32 of one or more pre-roll cone holders 702 (e.g. placing a plurality of pre-roll cones 20 into the plurality of pre-roll cone holders 702 provided by pre-roll cone holder assembly 70). At least one or more top portions 25 of the one or more pre-roll cones 20 protrude from the one or more sloped cavities 32 and through top openings 34.

Exemplary method 2100 further includes a pre-folding operation (process block 2104). In some embodiments this includes engaging one or more receptacles 41 of one or more pre-roll cone folders 3 with one or more pre-roll cone holders 2, causing the one or more receptacles 41 to slide over one or more top portions 25 of one or more pre-roll cones 20 protruding from one or more sloped cavities 32 of one or more pre-roll cone holders 702. These one or more top portions 25 may thus be slid into the receptacles 41 and engaged with one or more crimping segments 42 to become pre-folded cones 71.

In some particular embodiments using pre-roll cone holder assemblies 70 (see below) and pre-roll cone folder assemblies 80 (see below) this operation may be performed by causing bottom surface 89 (e.g. bottom surface 89 of FIGS. 8B-8D) of pre-roll cone folder assembly 80 to engage upper surface 78 of pre-roll cone holder assembly 70 while aligned via guide posts 83.

Exemplary method 2100 further includes a punch operation (process block 2106). In some embodiments the handle 51 of plunger 4 (e.g. a punch) may be gripped and directed to cause shaft 52 and shaper 53 to slide through a slot 43 of a pre-roll cone folder 3 and to engage a top portion 25 of a pre-roll cone 20.

Referencing FIG. 21, the pre-folding operation (process block 2104) may optionally include a engaging operation (process block 2109). In some embodiments the engaging operation includes at least engaging at least the given pre-roll cone 20 with a crimping segment 42 that is at least one of coupled with or integral with the receptacle 41, the crimping segment being shaped to pre-fold the pre-roll cone. In these embodiments. the crimping segment 42 has a shape 91 (e.g. of FIG. 4B) that is at least one of a cone shape or a dome shape.

The engaging operation (process block 2109) may optionally include a shape operation (process block 2110). In some embodiments the shape operation includes at least wherein the engaging causes the top portion of a pre-roll cone to be pre-folded into a shape 2204 (e.g. of FIG. 22) that is at least one of a crimped, tapered, cone shape, tent-like shape, or dome shape.

Exemplary method 2100 may optionally further include an eject operation (process block 2108). When one or more pre-roll cones 20 are inserted into one or more sloped cavities 32 of one or more pre-roll cone holders 2 at least one or more bottom portions 24 (e.g. filters) may protrude through one or more bottom openings 36 of the one or more pre-roll cone holders 2. In an ejection operation an ejector 5 (e.g. a flat piece of rigid material) may be applied against at least some of the protruding bottom portions 24 to expel the now folded cones 72.

Turning to FIGS. 9 to 20, this sequence of figures illustrate an exemplary method of using a pre-roll cone folding system 1 with a pre-roll cone holder assembly 70 and with a pre-roll cone folder assembly 80.

Figure 9:
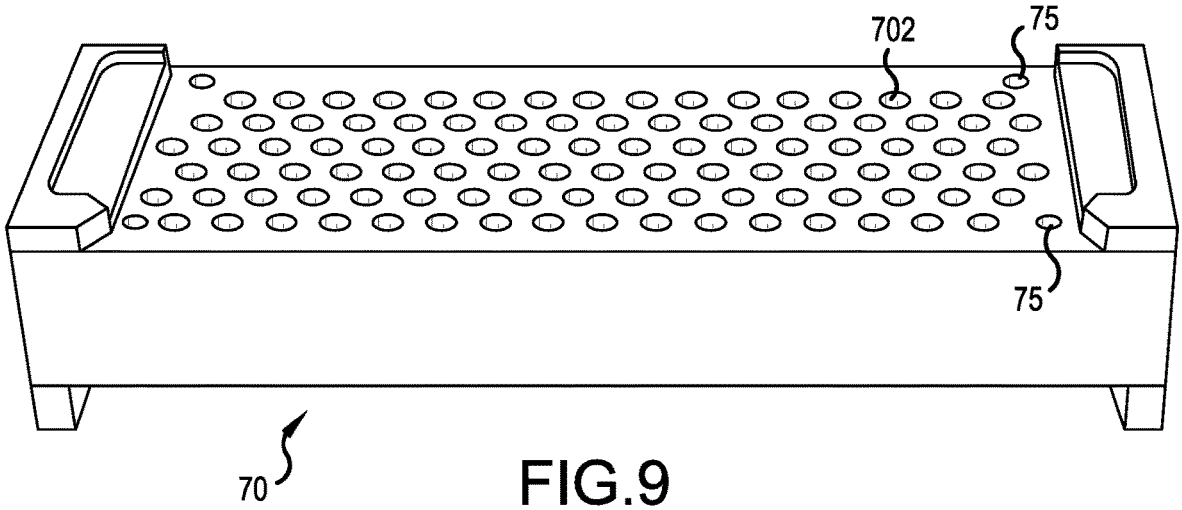
FIG. 9 is a perspective drawing of a pre-roll cone holder assembly consistent with some embodiments.

Referencing FIG. 9, a pre-roll cone holder assembly 70 is shown with its pre-roll cone holders 702 empty. First holes 75 are shown in pre-roll cone holder assembly 70 for use with guide posts 83 (see, e.g. FIG. 11).

Figure 10:
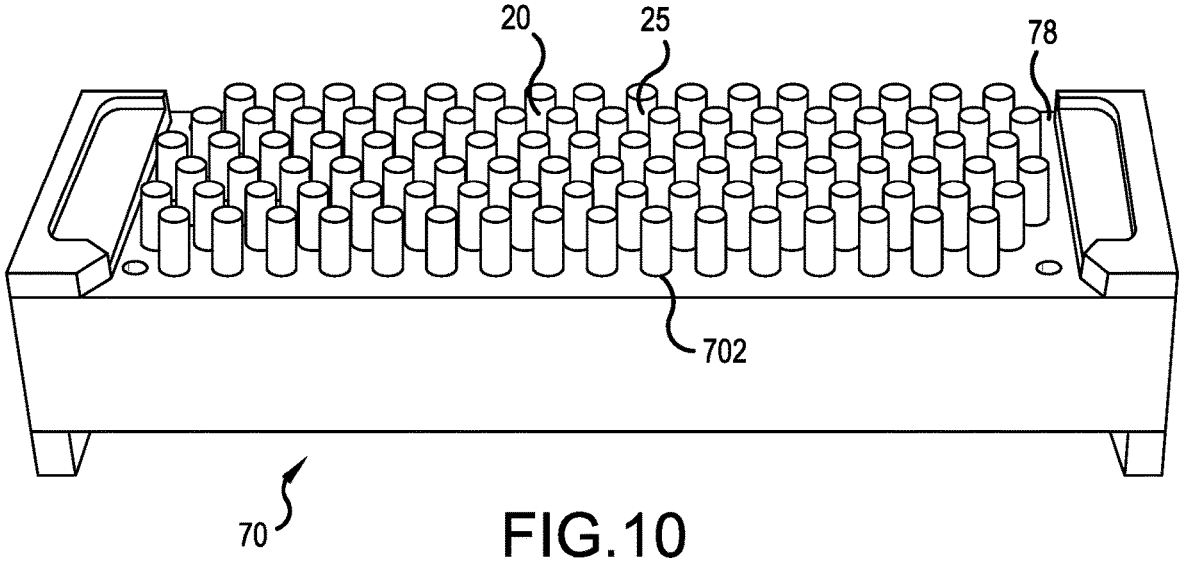
FIG. 10 is a perspective drawing of the pre-roll cone holder assembly of FIG. 9 consistent with some embodiments, showing the pre-roll cone holder assembly bearing a plurality of pre-roll cones.

Referencing FIG. 10 the pre-roll cone holder assembly 70 of FIG. 9 is shown bearing a plurality of pre-roll cones 20 in its plurality of pre-roll cone holders 702 with a plurality of top portions 25 of the plurality of pre-roll cones 20 protruding above the upper surface 78 of the pre-roll cone holder assembly 70.

Figure 11:
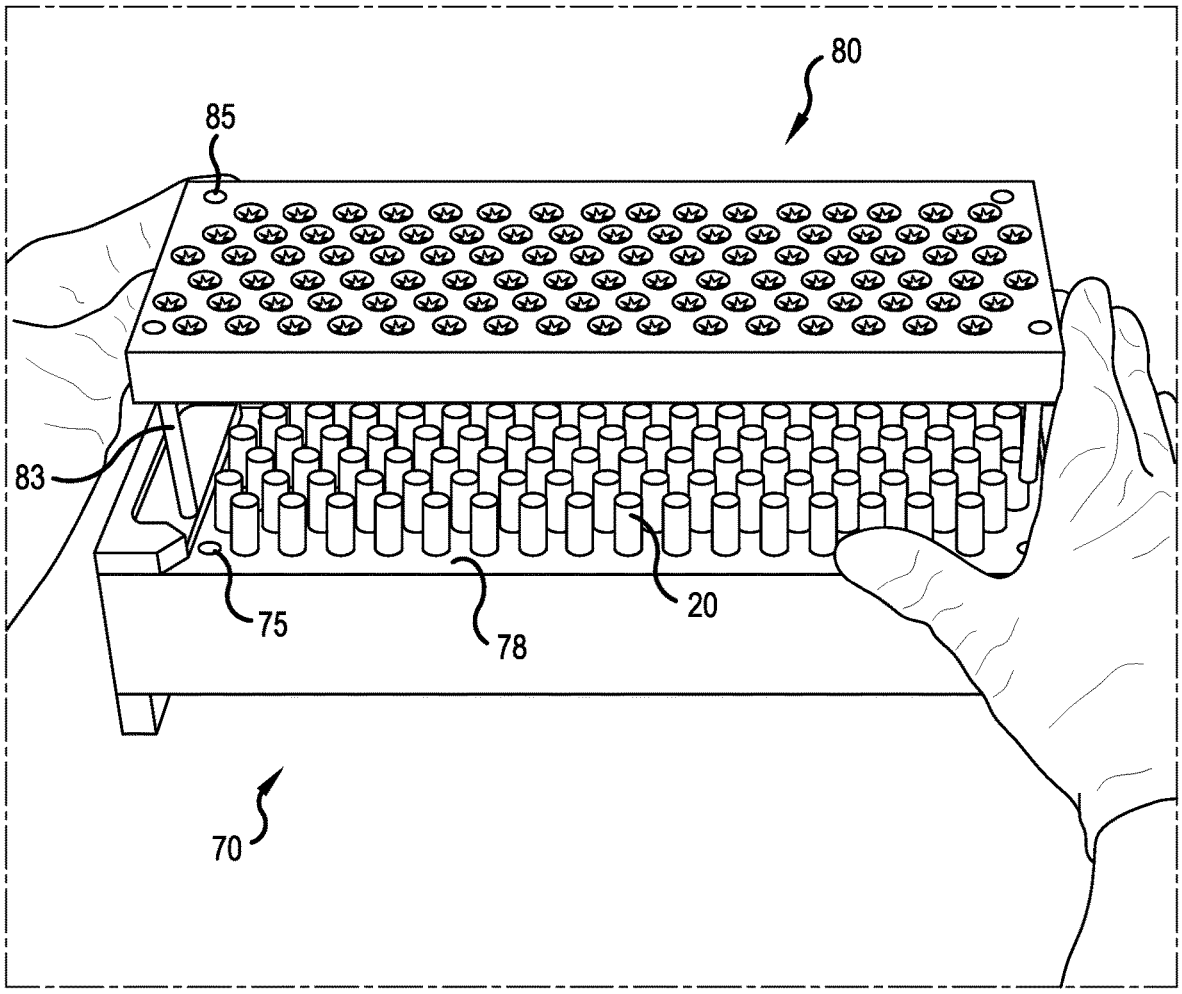
FIG. 11 is a perspective drawing of a pre-roll cone folder assembly in an early stage of being disposed on the plurality of pre-roll cones and on the pre-roll cone holder assembly of FIG. 10 consistent with some embodiments.

Referencing FIG. 11 a pre-roll cone folder assembly 80 (and its plurality of pre-roll cone folders 803) is shown in an early stage of being disposed (e.g. with assistance from one or more guide posts 83 for insertion into first holes 75 and second holes 85) on the plurality of pre-roll cones 20 and on the pre-roll cone holder assembly 70 of FIG. 10 (i.e. more specifically on the upper surface 78 of pre-roll cone holder assembly 70).

Referencing FIG. 12 the pre-roll cone folder assembly 80 of FIG. 11 (with its plurality of pre-roll cone folders 803) is shown in an later stage (relative to FIG. 11) of being disposed on the plurality of pre-roll cones 20 and on the pre-roll cone holder assembly 70 of FIGS. 10-11. This would cause the protruding top portions 25 (see discussion above relative to FIG. 10) be slid into receptacles 841 (shown in FIG. 8E) to engage crimping segments 42 of the plurality of pre-roll cone folders 803 (see discussion relative to FIGS. 4A and 4B) of pre-roll cone folder assembly 80.

Figure 12:
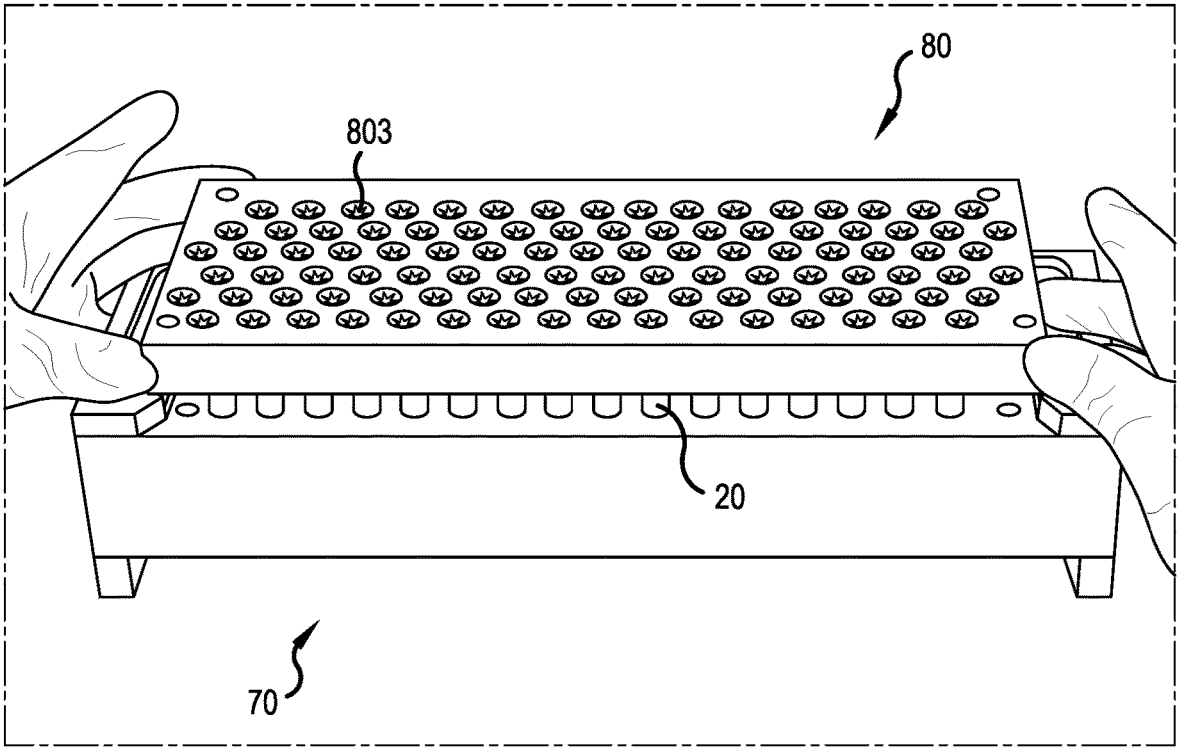
FIG. 12 is a perspective drawing of the pre-roll cone folder assembly of FIG. 11 in an later stage (relative to FIG. 11) of being disposed on the plurality of pre-roll cones and on the pre-roll cone holder assembly of FIGS. 10-11 consistent with some embodiments.

Referencing FIG. 13 a plunger 4 (e.g. plunger of FIG. 8D) is shown being inserted (e.g. via shaft 52) in a matching slot 43 (e.g. slot 43 shown in close-up in FIG. 8C) of the pre-roll cone folder assembly 80 of FIGS. 11-12 after the pre-roll cone folder assembly 80 is fully disposed on the plurality of pre-roll cones 20 (e.g. of FIG. 12) and the pre-roll cone holder assembly 70 of FIGS. 10-12.

Figure 14:
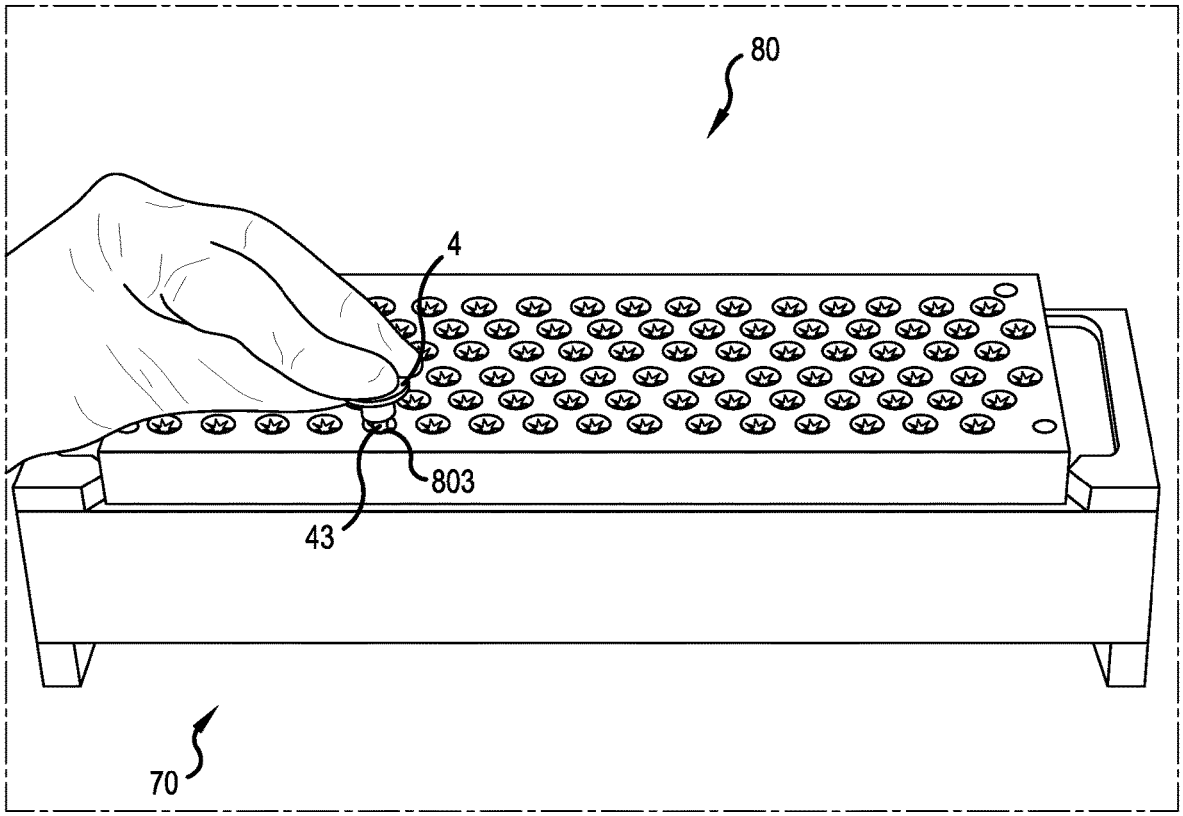
FIG. 14 is a perspective drawing of the plunger of FIG. 13 that is now shown fully inserted in the slot of the pre-roll cone folder assembly of FIGS. 11-13 after the pre-roll folder assembly is fully disposed on the pre-roll cone holder assembly of FIGS. 10-13 consistent with some embodiments.

Referencing FIG. 14 the plunger 4 of FIG. 13 is shown now fully inserted (e.g. via shaft 52) in the slot 43 of the pre-roll cone folder assembly 80 of FIGS. 11-13 after the pre-roll cone folder assembly 80 is fully disposed on the pre-roll cone holder assembly 70 of FIGS. 10-13. A shaper 53 of plunger 4 would engage protruding top portions 25 of pre-roll cones 20 (See e.g. FIG. 10) lodged in receptacle 841 to shape the top portions 25.

Figure 15:
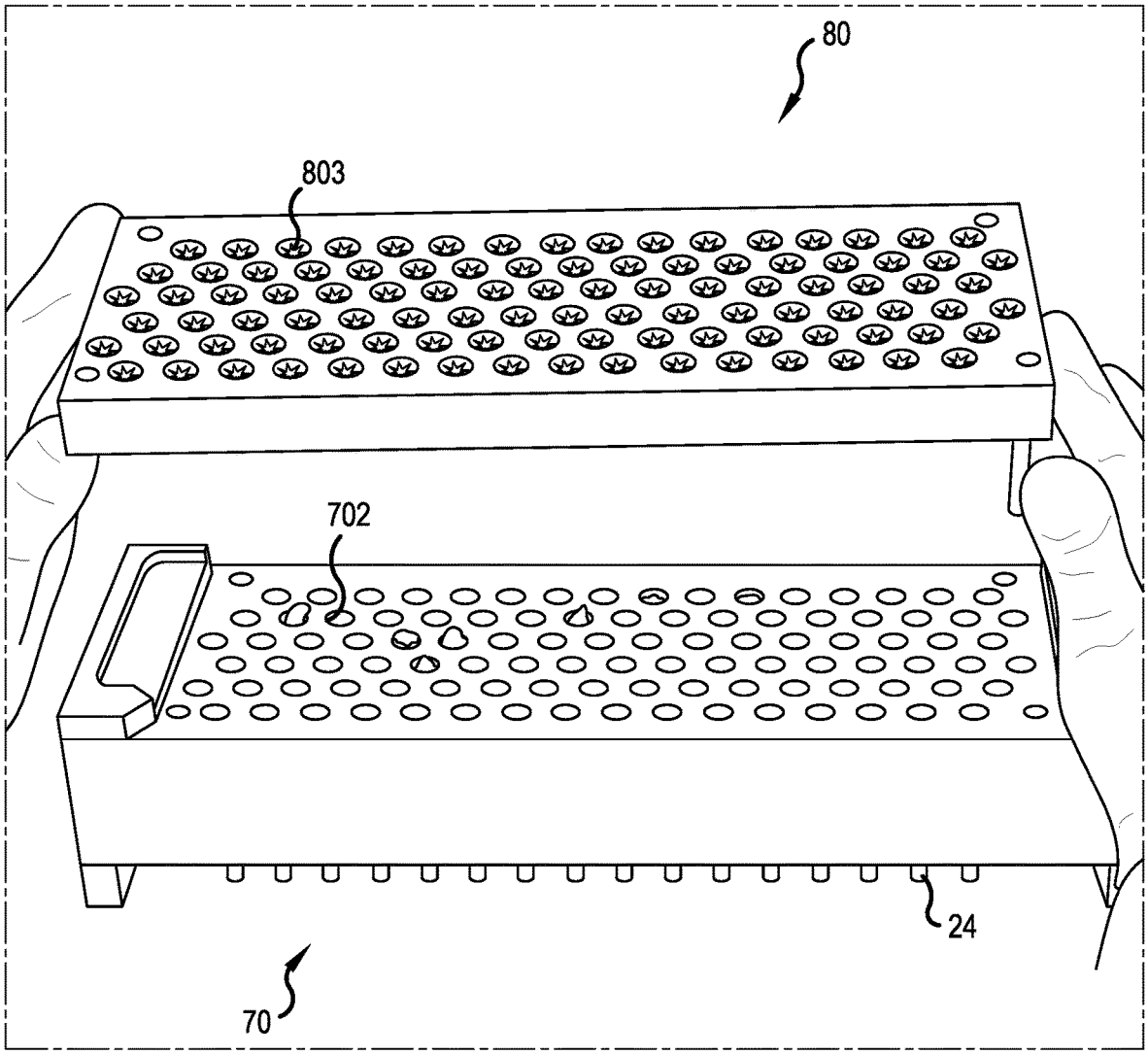
FIG. 15 is a perspective drawing of the pre-roll cone folder assembly of FIGS. 11-14 with the plunger removed and having been disengaged from the pre-roll cone holder assembly of FIGS. 10-14 consistent with some embodiments.

Referencing FIG. 15 the pre-roll cone folder assembly 80 of FIGS. 11-14 is shown with the plunger 4 removed and having been disengaged from the pre-roll cone holder assembly 70 of FIGS. 10-14.

Figure 16:
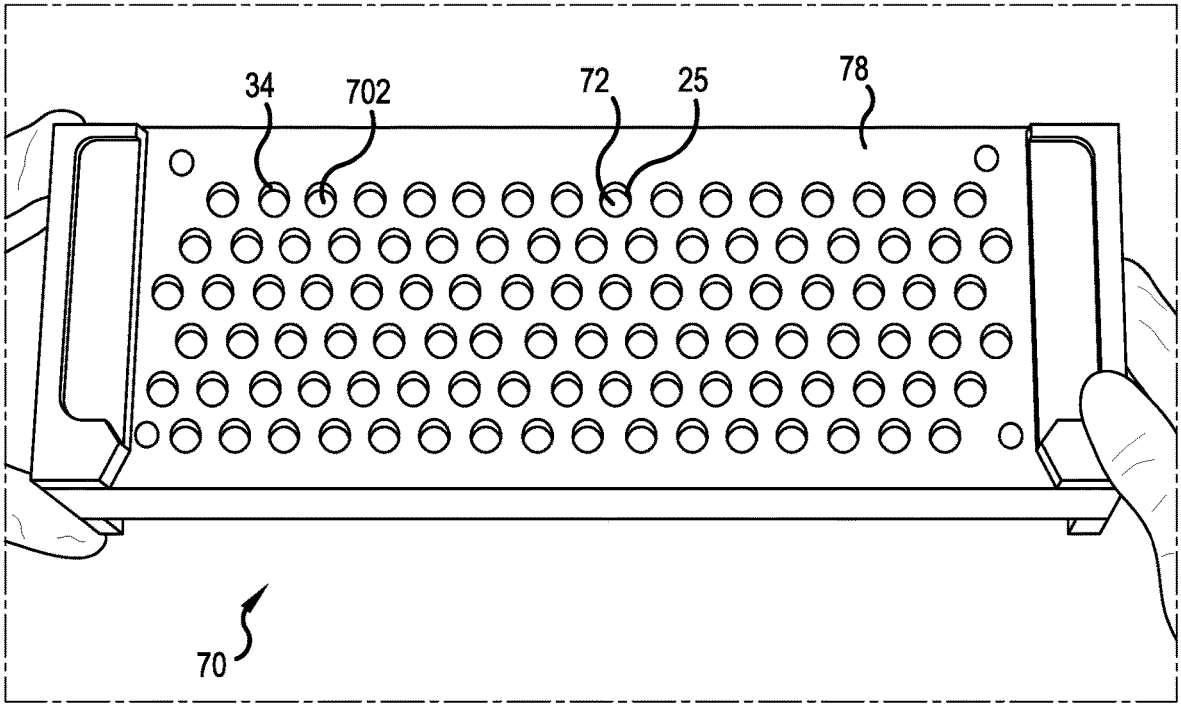
FIG. 16 is a perspective drawing of the pre-roll cone holder assembly of FIGS. 10-15 after disengagement from the pre-roll cone folder assembly, showing the upper surface of the pre-roll cone holder assembly, consistent with some embodiments.

Referencing FIG. 16 the pre-roll cone holder assembly 70 of FIGS. 10-15 is shown after disengagement from the pre-roll cone folder assembly 80. In particular shown is the upper surface 78 of the pre-roll cone holder assembly 70 with a plurality of top portions 25 of folded cones 72 visible through a plurality of top openings 34 of the plurality of pre-roll cone holders 702.

Figure 17:
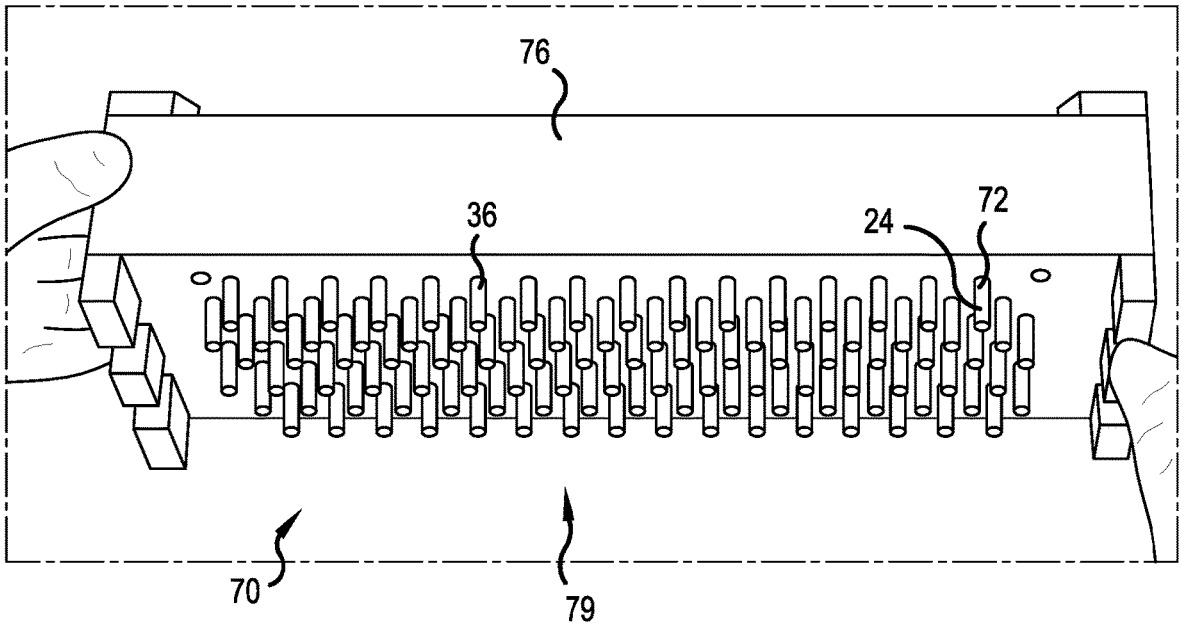
FIG. 17 is a perspective drawing of the pre-roll cone holder assembly of FIGS. 10-16 after disengagement from the pre-roll cone folder assembly showing at least the bottom portions of a plurality of folded cones protruding from the pre-roll cone holder assembly, consistent with some embodiments.

Referencing FIG. 17 the pre-roll cone holder assembly 70 of FIGS. 10-16 is shown after disengagement from the pre-roll cone folder assembly 80. In particular shown is at least a plurality of bottom portions 24 of now folded cones 72 protruding from a bottom surface 79 (e.g. and through a plurality of bottom openings 36 of the plurality of pre-roll cone holders 702) of the pre-roll cone holder assembly 70.

Figure 18:
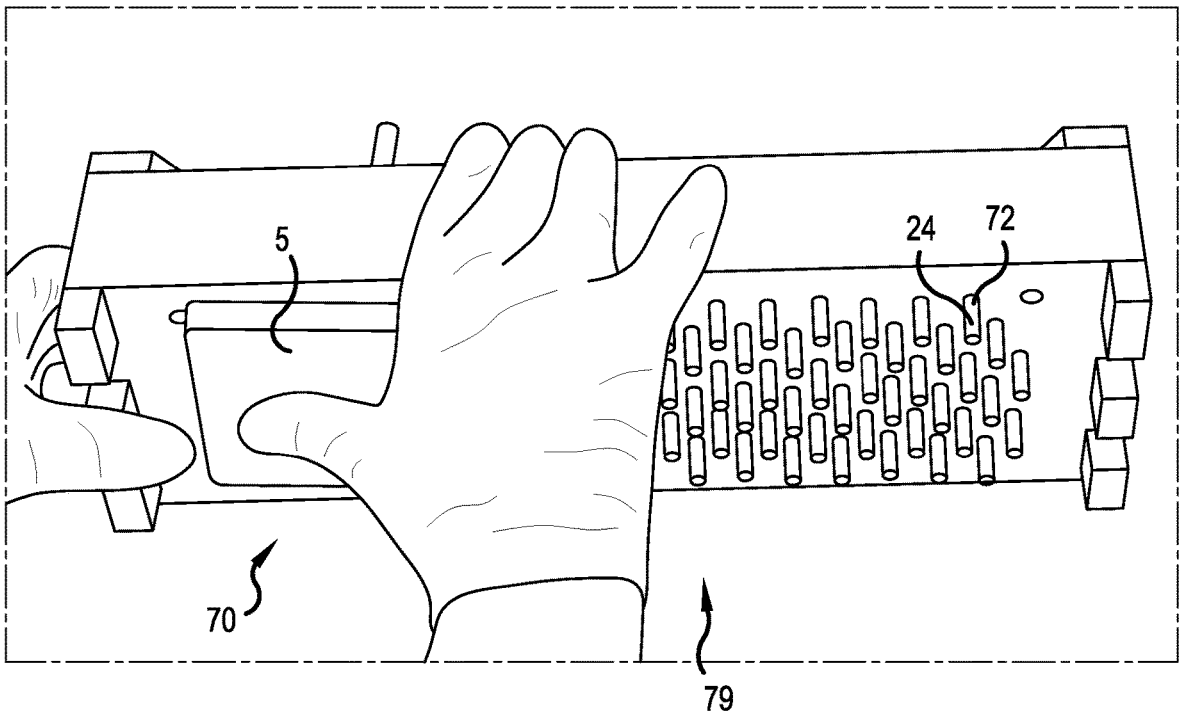
FIG. 18 is a perspective drawing of the pre-roll cone holder assembly of FIGS. 10-17 showing application of an ejector against the bottom portions of the plurality of folded cones protruding from the pre-roll cone holder assembly, consistent with some embodiments.

Referencing FIG. 18, this drawing shows application of an ejector 5 against the bottom portions 24 of now folded cones 72 protruding from bottom surface 79 of the pre-roll cone holder assembly 70 of FIGS. 10-17.

Figure 19:
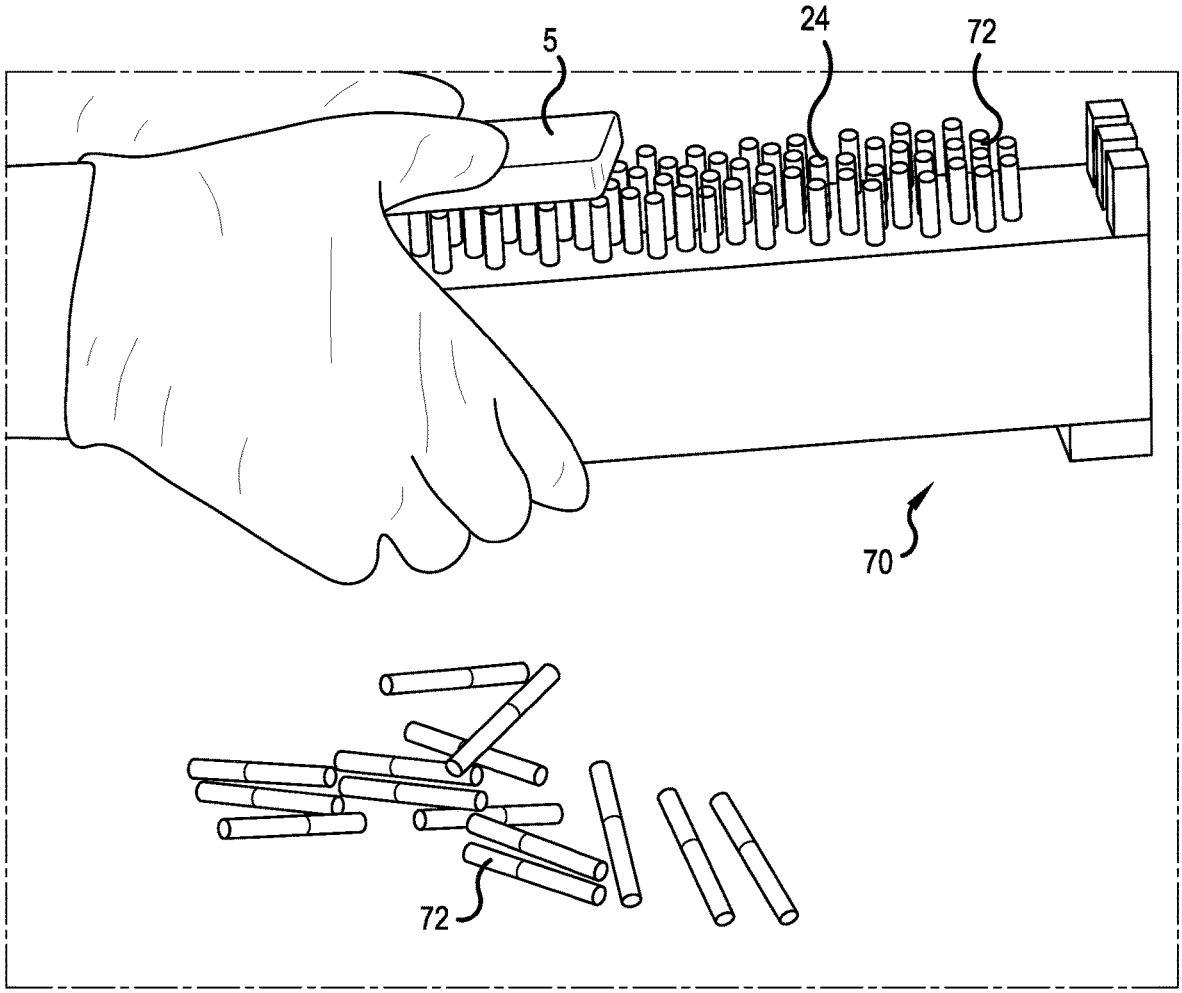
FIG. 19 is a perspective drawing of the pre-roll cone holder assembly of FIGS. 10-18 in an inverted position, showing placement of the ejector against some of the protruding bottom portions of the plurality of folded cones and further showing some of the plurality of folded cones ejected from the pre-roll cone holder assembly, consistent with some embodiments.

Referencing FIG. 19 the pre-roll cone holder assembly 70 of FIGS. 10-18 is shown in an inverted position. In particular shown is the placement of the ejector 5 against some of the protruding bottom portions 24 of the folded cones 72 and further showing folded cones 72 ejected from the pre-roll cone holder assembly 70.

Figure 20:
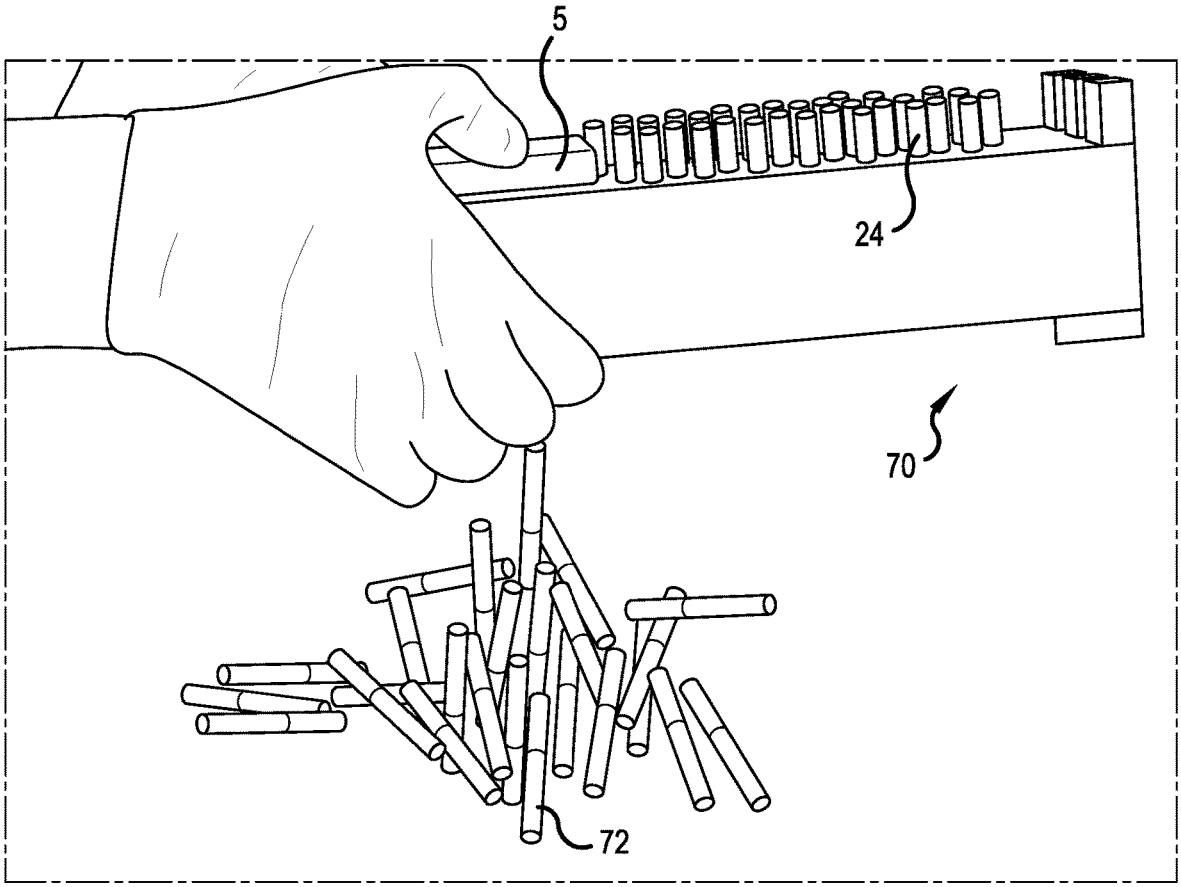
FIG. 20 is a perspective drawing of the pre-roll cone holder assembly of FIGS. 10-18 in an inverted position, showing completed application of the ejector against some of the previously protruding bottom portions of the plurality of folded cones and further showing some of the plurality of folded cones ejected from the pre-roll cone holder assembly, consistent with some embodiments.

Referencing FIG. 20 the pre-roll cone holder assembly 70 of FIGS. 10-19 in an inverted position, showing completed application of the ejector 5 against some of the previously protruding bottom portions 24 and further showing folded cones 72 ejected from the pre-roll cone holder assembly 70.

Referencing FIG. 22, shown are a pre-roll cone 20, a pre-folded cone 71 (e.g. pre-folded by crimping segment 42 but not shaped by shaper 53 of plunger 4), and a folded cone 72.

Again referencing FIG. 21, in some embodiments, the method 2100 of using a pre-roll cone folding system, discussed above, is adapted for use with a pre-roll cone holder assembly 70 and with a pre-roll cone folder assembly 80. Adapted method 2100 may preliminarily and optionally include at least semi-filling (must not be overfilled or they will not fold properly) one or more empty pre roll cones (e.g. pre-roll cones 20) with a desired amount of tobacco or herb. The one or more semi-filled pre roll cones may be placed in one or more pre roll cone holders (e.g. pre-roll cone holders 702) of a pre-roll cone holder assembly (e.g. pre-roll cone holder assembly 70)(see, process block 2102). A pre-roll cone folder assembly (e.g. pre-roll cone folder assembly 80) may be positioned over the pre-roll cone holder assembly with the aid of four guide posts (e.g. guide posts 83). The pre-roll cone folder assembly may be slid into place onto the upper surface (e.g. top) of the pre-roll cone holder assembly (see, process block 2104). The plunger (e.g. plunger 4) is then slid into and out of the slots (e.g. slots 43) of the pre-roll cone folders of the pre-roll cone folder assembly (see, process block 2106). The pre-roll-cone folder assembly is then removed from the pre-roll cone holder assembly. At this point folded pre-roll cones (e.g. folded cones 72) may be folded and ready to be ejected (e.g. with ejector 5) from the pre roll cone holders of the pre-roll cone holder assembly (see, process block 2108).

The embodiments of at least pre-roll cone holder assembly 70 and/or pre-roll cone folder assembly 80 can be produced by being 3d printed using various types of plastics such as PLA (polylactic acid), ABS (Acrylonitrile Butadiene Styrene) etc. Other embodiments of at least pre-roll cone holder assembly 70 and/or pre-roll cone folder assembly 80 can be produced by being machined from metal (e.g. aluminum, steel, etc.) using a CNC (computerized numerical control) milling machine.

Various embodiments are now discussed.

In some embodiments, a pre-roll cone folding system (e.g. system 1 which may include individual pre-roll cone holders 2 and individual pre-roll cone folders 2 and/or one or more pre-roll cone holder assemblies 70 and one or more pre-roll cone folder assemblies 80) is configured for use in folding one or more top portions (e.g. 25) of one or more pre-roll cones (e.g. 20). The system may include one or more pre-roll cone holders (e.g. 2, 702), a given pre-roll cone holder of the one or more pre-roll cone holders including at least one or more supporting walls (e.g. 33) defining a cavity (e.g. when there is a bottom opening 36, then shape of cavity is at least one of a tapered tube or a tapered channel), the one or more supporting walls configured for supporting a given pre-roll cone of the one or more pre-roll cones in the cavity with a top portion (e.g. 25) of the given pre-roll cone protruding from the cavity (see, e.g. FIG. 10).

The system may further include one or more pre-roll cone folders (e.g. 3, 803) configured for engaging the one or more pre-roll cone holders, a given pre-roll cone folder of the one or more pre-roll cone folders including at least (1) a receptacle (e.g. 41, 841) defining a receiving cavity (e.g. 47, 847) configured for receiving at least a portion of the protruding top portion of the given pre-roll cone thereby pre-folding the top portion (e.g. to create pre-folded cone 71) and (2) a slot (e.g. 43) for accessing the receptacle.

And the system may further include a pre-roll cone plunger (e.g. 4) configured with a shaft (e.g. 52) for insertion through the slot of the given pre-roll cone folder and further configured with an end (e.g. 54) of the shaft for contacting the protruding top portion of the given pre-roll cone thereby folding the top portion (e.g. to create a folded cone 72).

In some embodiments, the given pre-roll cone holder defines a bottom opening (e.g. 36) of the cavity of the given pre-roll cone, the cavity having at least one of a tubular shape or a channel-like shape. In these embodiments, the one or more walls are further configured for supporting the pre-roll cone in the cavity with a bottom portion of the given pre-roll cone at least partly protruding from the bottom opening of the cavity (see e.g. at least FIGS. 15, 17). And in these embodiments the system further includes at least a cone ejector configured for use in ejecting a folded cone (see e.g. at least FIGS. 18-20) from the cavity.

In some embodiments the given pre-roll cone folder further comprises a crimping segment (e.g. 42) that is at least one of coupled with or integral with the receptacle that is shaped to pre-fold the pre-roll cone. In some further embodiments, the slot is placed and configured for insertion of the shaft of the plunger through the crimping segment into the receiving cavity.

In some embodiments, the cavity is a sloped cavity (see e.g. FIG. 3B). The slope being sufficient to prevent a pre-roll cone bottom from falling out of the cavity through a bottom opening.

In some embodiments, the end of the shaft of the plunger defines a shaper (e.g. 53) that defines a shape that is at least one of a 6-pointed cross, a five-pointed cross, a square, a triangle, or a circle and the slot is shaped for insertion of the shaper.

In some embodiments, the one or more walls define a top opening (e.g. 34) of the cavity and wherein the top portion of the given pre-roll cone, when supported in the cavity, at least partly extends through the top opening. In some further embodiments, the one or more walls further define a bottom opening (e.g. 36) of the cavity, the cavity having at least one of a tubular tapered shape or a channel-like tapered shape and the bottom portion of the given pre-roll cone, when supported in the cavity, at least partly extends through the bottom opening.

In some embodiments the one or more pre-roll cone holders includes at least a plurality of pre-roll cone holders, the one or more pre-roll cone holders includes at least a plurality of pre-roll cone folders and the system further includes at least (1) at least one pre-roll cone holder assembly (e.g. 70) that includes at least some of the plurality of pre-roll cone holders, and (2) at least one pre-roll cone folder assembly (e.g. 80) that includes at least some of the plurality of pre-roll cone folders.

In some embodiments, the receiving cavity of the given pre-roll cone folder is configured, including being sized, to receive at least a portion of the given pre-roll cone holder (e.g. see FIG. 4C) while at least the top portion of a pre-roll cone protrudes from the cavity, positioned for crimping with the crimping segment.

Some embodiments provide a method of folding one or more top portions of one or more pre-roll cones. The method includes at least inserting the one or more pre-roll cones into one or more pre-roll cone holders, the inserting including at least inserting a given pre-roll cone of the one or more pre-roll cones into a cavity defined by one or more supporting walls of a given pre-roll cone holder of the one or more pre-roll cone holders with a top portion of the given pre-roll cone protruding from the cavity.

The method further includes at least engaging the one or more pre-roll cones and the one or more pre-roll cone holders with one or more pre-roll cone folders, the engaging including at least engaging at least the given pre-roll cone with a receptacle of a given pre-roll cone folder of the one or more pre-roll cone folders, the engaging including at least receiving and disposing the protruding top portion of the given pre-roll cone within the receiving cavity and at least pre-folding the protruding top portion by contact with the receptable.

And the method further includes at least punching at least part of the top portion disposed within the receiving cavity with an end of a shaft of a pre-roll cone plunger, the punching including at least inserting the end of the shaft through a slot of the given pre-roll cone folder to punch at least the top portion, causing the given pre-folded cone to become a folded cone.

In some embodiments a bottom portion of the given pre-roll cone protrudes through a bottom opening of the cavity and the method further includes at least ejecting the folded cone from the cavity of the given pre-roll cone holder with a cone ejector at least in part by contacting the protruding bottom portion of the folded cone with the cone ejector.

In some embodiments the at least engaging at least the given pre-roll cone with a receptacle of a given pre-roll cone folder includes at least engaging at least the given pre-roll cone with a crimping segment that is at least one of coupled with or integral with the receptacle, the crimping segment being shaped to pre-fold the pre-roll cone and the crimping segment has a shape that is at least one of a cone shape or a dome shape. In some further embodiments the engaging causes the top portion of the given pre-roll cone to be pre-folded into a shape that is at least one of a crimped, tapered, cone shape, tent-like shape, or dome shape.

Some embodiments provide a pre-roll cone folding system configured for use in folding one or more top portions of one or more pre-roll cones. The system includes at least a pre-roll cone holder assembly (e.g. 70) defining a plurality of pre-roll cone holders (e.g. 702), a given pre-roll cone holder of the plurality including at least one or more supporting walls defining a cavity, the one or more walls configured for supporting a given pre-roll cone with a top portion of the given pre-roll cone at least partly protruding from the cavity The system further includes at least a pre-roll cone folder assembly (e.g. 80) defining a plurality of pre-roll cone folders (e.g. 803) configured for engaging the plurality of pre-roll cone holders, a given pre-roll cone folder of the plurality of pre-roll cone folders including at least (1) a receptacle defining a receiving cavity that is configured to receive at least a portion of the protruding top portion of the given pre-roll cone, the receptable configured for contacting and pre-folding the received top portion of the given pre-roll cone, causing the pre-roll cone to become a pre-folded cone, and (2) a slot defined through the receptacle of the given pre-roll cone folder for accessing the receiving cavity.

And the system further includes at least a pre-roll cone plunger configured with a shaft with an end, the shaft configured for insertion of the end of the shaft through the slot to make contact with the protruding top portion of the pre-folded cone to fold the top portion, causing the pre-folded cone to become a folded cone.

In some embodiments, the pre-roll cone holder assembly defines a bottom opening of the cavity of the given pre-roll cone holder, the one or more walls of the given pre-roll cone holder are further configured for supporting the folded cone in the cavity of the given pre-roll cone holder with a bottom portion of the folded cone at least partly protruding from the bottom opening of the cavity, and the system further includes at least an ejector configured for being applied against the protruding bottom portion of the folded cone to eject the folded cone from the cavity.

In some embodiments, the pre-roll cone holder assembly defines an upper surface (e.g. 78), the upper surface defining a top opening of the given pre-roll cone holder for accessing the cavity of the given pre-roll cone holder. In some further embodiments the pre-roll cone folder assembly defines a bottom surface (e.g. 79), the bottom surface defining a receiving opening of the given pre-roll cone folder for accessing the receiving cavity defined by the receptacle of the given pre-roll cone holder, and the pre-roll cone holder assembly is configured to mate with the pre-roll cone folder assembly (see e.g. at least FIG. 14, with plunger 4 inserted in slot 43) with the top opening of the given pre-roll cone holder at least partly aligning with the receiving opening of the given pre-roll cone folder, wherein the at least partial aligning permits a top portion of the given pre-roll cone that is supported in the cavity of the given pre-cone holder to be inserted into the receiving opening of the given pre-roll cone folder.

In some yet further embodiments, the system further comprises a guide (e.g. guide post 83) for aligning the top opening of the given pre-roll cone holder with the receiving opening of the given pre-roll cone folder. And in some yet further embodiments, the guide includes at least a plurality of guide posts configured to be inserted into respective first holes (e.g. 75) in the pre-roll cone holder assembly and second holes (e.g. 85) in the pre-roll cone folder assembly.

It will be understood by those skilled in the art that the terminology used in this specification and in the claims is "open" in the sense that the terminology is open to additional elements not enumerated. For example, the words "includes" should be interpreted to mean "including at least" and so on. In addition, articles such as "a" or "the" should be interpreted as not referring to a specific number, such as one, unless explicitly indicated. At times a convention of "at least one of A, B, or C" is used, the intent is that this language includes any of A alone, B alone, C alone, A and B, B and C, A and C, all of A, B, and C, or any combination thereof (e.g. A, A, B, and C, etc.). The same is indicated by the conventions "one of more of A, B, or C." Similarly, the phrase "A, B, and/or C" is intended to include any of A alone, B alone, C alone, A and B, B and C, A and C, all of A, B, and C or any combination thereof (e.g. A, A, B, and C, etc.). With parentheticals such as (e.g. A, B, C), it is intended that this refer to any or all of A alone, B alone, or C alone and to any combination thereof that is applicable in the particular context.

And as previously indicated elements, components, or operations should not be regarded as essential unless they are so explicitly described. The teaches contained herein may be adapted to a variety of embodiments arranged and composed in a wide variety of ways.

The above description of various embodiments is intended to be illustrative not exhaustive and is not intended to limit this disclosure, its application, or uses. Those skilled in the art will be able to imagine embodiments not described but that are consistent with the principles and teachings described herein. Therefore, the above description of exemplary embodiments is not intended to limit the scope of this disclosure, which should be defined only in accordance with the following claims and equivalents thereof.

We claim:

1. A pre-roll cone folding system configured for use in folding one or more top portions of one or more pre-roll cones, the system comprising:

one or more pre-roll cone holders, a given pre-roll cone holder of the one or more pre-roll cone holders including at least one or more supporting walls defining a cavity, the one or more supporting walls configured for supporting a given pre-roll cone of the one or more pre-roll cones in the cavity with a top portion of the given pre-roll cone protruding from the cavity;

one or more pre-roll cone folders configured for engaging the one or more pre-roll cone holders, a given pre-roll cone folder of the one or more pre-roll cone folders including at least (1) a receptacle defining a receiving cavity configured for receiving at least a portion of the protruding top portion of the given pre-roll cone thereby pre-folding the top portion and (2) a slot for accessing the receptacle; and a pre-roll cone plunger configured with a shaft for insertion through the slot of the given pre-roll cone folder and further configured with an end of the shaft for contacting the protruding top portion of the given pre-roll cone thereby folding the top portion.

2. The system of claim 1, wherein the given pre-roll cone holder defines a bottom opening of the cavity of the given pre-roll cone, the cavity having at least one of a tubular shape or a channel-like shape;

wherein the one or more walls are further configured for supporting the pre-roll cone in the cavity with a bottom portion of the given pre-roll cone at least partly protruding from the bottom opening of the cavity; and the system further comprising a cone ejector configured for use in ejecting a folded cone from the cavity.

3. The system of claim 1, wherein the given pre-roll cone folder further comprises a crimping segment that is at least one of coupled with or integral with the receptacle that is shaped to pre-fold the pre-roll cone.

4. The system of claim 3, wherein the slot is placed and configured for insertion of the shaft of the plunger through the crimping segment into the receiving cavity.

5. The system of claim 1, wherein the cavity is a sloped cavity.

6. The system of claim 1, wherein the end of the shaft of the plunger defines a shaper that defines a shape that is at least one of a 6-pointed cross, a five-pointed cross, a square, a triangle, or a circle; and wherein the slot is shaped for insertion of the shaper.

7. The system of claim 1, wherein the one or more walls define a top opening of the cavity and wherein the top portion of the given pre-roll cone, when supported in the cavity, at least partly extends through the top opening.

8. The system of claim 7, wherein the one or more walls further define a bottom opening of the cavity, the cavity having at least one of a tubular tapered shape or a channel-like tapered shape; and wherein the bottom portion of the given pre-roll cone, when supported in the cavity, at least partly extends through the bottom opening.

9. The system of claim 1 wherein:

the one or more pre-roll cone holders includes at least a plurality of pre-roll cone holders;

the one or more pre-roll cone holders includes at least a plurality of pre-roll cone folders; and the system further including at least:

at least one pre-roll cone holder assembly that includes at least some of the plurality of pre-roll cone holders; and at least one pre-roll cone folder assembly that includes at least some of the plurality of pre-roll cone folders.

10. The system of claim 1, wherein the receiving cavity of the given pre-roll cone folder is configured, including being sized, to receive at least a portion of the given pre-roll cone holder while at least the top portion of a pre-roll cone protrudes from the cavity, positioned for crimping with the crimping segment.

11. A method of folding one or more top portions of one or more pre-roll cones, the method comprising:

inserting the one or more pre-roll cones into one or more pre-roll cone holders, the inserting including at least inserting a given pre-roll cone of the one or more pre-roll cones into a cavity defined by one or more supporting walls of a given pre-roll cone holder of the one or more pre-roll cone holders with a top portion of the given pre-roll cone protruding from the cavity;

engaging the one or more pre-roll cones and the one or more pre-roll cone holders with one or more pre-roll cone folders, the engaging including at least engaging at least the given pre-roll cone with a receptacle of a given pre-roll cone folder of the one or more pre-roll cone folders, the engaging including at least receiving and disposing the protruding top portion of the given pre-roll cone within the receiving cavity and at least pre-folding the protruding top portion by contact with the receptable; and punching at least part of the top portion disposed within the receiving cavity with an end of a shaft of a pre-roll cone plunger, the punching including at least inserting the end of the shaft through a slot of the given pre-roll cone folder to punch at least the top portion, causing the given pre-folded cone to become a folded cone.

12. The method of claim 11, wherein a bottom portion of the given pre-roll cone protrudes through a bottom opening of the cavity; and wherein the method further includes at least ejecting the folded cone from the cavity of the given pre-roll cone holder with a cone ejector at least in part by contacting the protruding bottom portion of the folded cone with the cone ejector.

13. The method of claim 11, wherein the at least engaging at least the given pre-roll cone with a receptacle of a given pre-roll cone folder comprises:

engaging at least the given pre-roll cone with a crimping segment that is at least one of coupled with or integral with the receptacle, the crimping segment being shaped to pre-fold the pre-roll cone; and wherein the crimping segment has a shape that is at least one of a cone shape or a dome shape.

14. The method of claim 13, wherein the engaging causes the top portion of the given pre-roll cone to be pre-folded into a shape that is at least one of a crimped, tapered, cone shape, tent-like shape, or dome shape.

15. A pre-roll cone folding system configured for use in folding one or more top portions of one or more pre-roll cones, the system comprising:

a pre-roll cone holder assembly defining a plurality of pre-roll cone holders, a given pre-roll cone holder of the plurality including at least one or more supporting walls defining a cavity, the one or more walls configured for supporting a given pre-roll cone with a top portion of the given pre-roll cone at least partly protruding from the cavity;

a pre-roll cone folder assembly defining a plurality of pre-roll cone folders configured for engaging the plurality of pre-roll cone holders, a given pre-roll cone folder of the plurality of pre-roll cone folders including at least (1) a receptacle defining a receiving cavity that is configured to receive at least a portion of the protruding top portion of the given pre-roll cone, the receptable configured for contacting and pre-folding the received top portion of the given pre-roll cone, causing the pre-roll cone to become a pre-folded cone, and (2) a slot defined through the receptacle of the given pre-roll cone folder for accessing the receiving cavity; and a pre-roll cone plunger configured with a shaft with an end, the shaft configured for insertion of the end of the shaft through the slot to make contact with the protruding top portion of the pre-folded cone to fold the top portion, causing the pre-folded cone to become a folded cone.

16. The system of claim 15, wherein the pre-roll cone holder assembly defines a bottom opening of the cavity of the given pre-roll cone holder;

wherein the one or more walls of the given pre-roll cone holder are further configured for supporting the folded cone in the cavity of the given pre-roll cone holder with a bottom portion of the folded cone at least partly protruding from the bottom opening of the cavity; and wherein the system further includes at least an ejector configured for being applied against the protruding bottom portion of the folded cone to eject the folded cone from the cavity.

17. The system of claim 15, wherein the pre-roll cone holder assembly defines an upper surface, the upper surface defining a top opening of the given pre-roll cone holder for accessing the cavity of the given pre-roll cone holder.

18. The system of claim 17, wherein the pre-roll cone folder assembly defines a bottom surface, the bottom surface defining a receiving opening of the given pre-roll cone folder for accessing the receiving cavity defined by the receptacle of the given pre-roll cone holder; and wherein the pre-roll cone holder assembly is configured to mate with the pre-roll cone folder assembly with the top opening of the given pre-roll cone holder at least partly aligning with the receiving opening of the given pre-roll cone folder, wherein the at least partial aligning permits a top portion of the given pre-roll cone that is supported in the cavity of the given pre-cone holder to be inserted into the receiving opening of the given pre-roll cone folder.

19. The system of claim 18, wherein the system further comprises a guide for aligning the top opening of the given pre-roll cone holder with the receiving opening of the given pre-roll cone folder.

20. The system of claim 19, wherein the guide includes at least a plurality of guide posts configured to be inserted into respective first holes in the pre-roll cone holder assembly and second holes in the pre-roll cone folder assembly.

* * * * *